US007042447B2

(12) United States Patent
Numao

(10) Patent No.: US 7,042,447 B2
(45) Date of Patent: May 9, 2006

(54) DISPLAY DEVICE AND DISPLAY METHOD

(75) Inventor: Takaji Numao, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 246 days.

(21) Appl. No.: 10/230,627

(22) Filed: Aug. 29, 2002

(65) Prior Publication Data

US 2003/0058200 A1 Mar. 27, 2003

(30) Foreign Application Priority Data

Aug. 30, 2001 (JP) ..... 2001-262365
Apr. 22, 2002 (JP) ..... 2002-119668

(51) Int. Cl.
*G09G 5/00* (2006.01)

(52) U.S. Cl. ..... 345/205; 345/90; 345/211

(58) Field of Classification Search ..... 345/205, 345/87–101, 204, 211
See application file for complete search history.

(56) References Cited

U.S. PATENT DOCUMENTS 4,781,437 A * 11/1988 Shields et al. ..... 345/87
4,996,523 A 2/1991 Bell et al. ..... 340/781
5,471,225 A * 11/1995 Parks ..... 345/98
5,627,557 A 5/1997 Yamaguchi et al. ..... 345/90
6,243,066 B1 * 6/2001 Murakami et al. ..... 345/98
6,295,054 B1 * 9/2001 McKnight ..... 345/205
6,452,589 B1 * 9/2002 McKnight ..... 345/205
6,765,549 B1 * 7/2004 Yamazaki et al. ..... 345/80
6,806,855 B1 * 10/2004 Miura et al. ..... 345/87

FOREIGN PATENT DOCUMENTS

JP 08-194205 7/1996
JP 2000-227608 8/2000

OTHER PUBLICATIONS

H. Tokioka et al., "Low Power Consumption TFT-LCD with Dynamic Memory Embedded in Pixels." SID 01 DIGEST, 2001, p. 280-283.

* cited by examiner

*Primary Examiner*—Kent Chang
(74) *Attorney, Agent, or Firm*—David G. Conlin; John J. Penny, Jr.; Edwards Angell Palmer & Dodge LLP

(57) ABSTRACT

A display device of the present invention is provided with (a) electro-optic elements respectively composed of an n-type TFT and an organic EL element, which are arranged in a matrix, each of the electro-optic elements being arranged in a vicinity of an intersection of a data line and a gate line, (b) a condenser for holding a potential so as to drive and display the electro-optic element, (c) a buffer circuit for outputting a potential supplied from the condenser, (d) a p-type TFT and an n-type TFT provided in series with the condenser, and (e) an n-type TFT provided between the data line and the p-type and n-type TFTs, wherein a plurality of the condensers are provided with respect to each of the electro-optic elements, and the plurality of condensers are connected to an output terminal of the buffer circuit. This reduces the number of TFTs required per 1 bit of memory element and reduces a scale of a driver circuit arranged around a display screen.

19 Claims, 21 Drawing Sheets

PIXEL DIRECTIONS
(HORIZONTAL, VERTICAL, OBLIQUE)
8
6
8
8
4
2
8
4
2
6
8
13
TIME
ONE FIELD PERIOD

PIXEL DIRECTIONS
(HORIZONTAL, VERTICAL, OBLIQUE)
8
6
4
2
2
2
4
4
2
2
2
4
6
8
10
TIME

Alq

Zn(oxz)2

DCM

TPD

CuPc

DISPLAY DEVICE AND DISPLAY METHOD

FIELD OF THE INVENTION

The present invention relates to a display device using an electro-optic element composed of a TFT (Thin Film Transistor) silicone substrate and a display method using the same, and in particular to a display device using organic EL (Electro Luminescence) or liquid crystal as an electro-optic element and a display method using the same.

BACKGROUND OF THE INVENTION

In recent years, development of display devices such as a liquid crystal display device, an EL display device, and an FED (Field Emission Display) display device has been actively carried out. The liquid crystal display device and the EL display device, in particular, have come to receive attention as a display device for a cellular phone, a portable personal computer, etc., because they are light in weight and consume small electric power. However, as more and more functions are mounted on these portable devices, highly demanded is a display device which is lighter in weight and which consumes smaller electric power.

Japanese Unexamined Patent Publication No. 8-194205/1996 (Tokukaihei 8-194205, published on Jul. 30, 1996) discloses a technique which is conventionally used for realizing a display device which consumes smaller electric power. With this, by providing a memory function to each pixel so as to switch a reference voltage corresponding to a content stored in the memory, cyclical rewriting is suspended while an identical pixel is displayed, thereby reducing electric power consumed by a drive circuit.

More specifically, as shown in FIG. 14, pixel electrodes 202 are arranged in a matrix on a first glass substrate. Between the pixel electrodes 202, scanning lines 203 and signal lines 204 are provided so as to cross at right angle. Reference lines 205 are provided in parallel to the scanning lines 203. A memory element 206 (described later) is provided at each intersection of the scanning lines 203 and the signal lines 204 in such a manner that a switch element 207 is respectively provided between the memory element 206 and the corresponding pixel electrode 202.

The scanning lines 203 are selectively controlled by a scanning line driver 208 per vertical cycle, the signal lines 204 are collectively controlled by a signal line driver 209 per horizontal cycle, and the reference lines 205 are collectively controlled by a reference line driver 210. A second glass substrate is arranged so as to face the first glass substrate at a predetermined distance, and a counter electrode is formed on a counter surface on the second glass substrate. As a display material, liquid crystal which is an electro-optic element is sealed between the two glass substrates which have surfaces formed with alignment films.

FIG. 15 is a circuit diagram showing a detailed arrangement of each pixel section in FIG. 14. Each intersection of the scanning lines 203 and the signal lines 204, which are formed so as to cross at right angles with each other, is provided with the memory element 206 for holding binary data. The memory element 206 is provided with an output section for outputting the holding information. The output section is connected to the switch element 207 having three terminals. The information held in the memory element 206 is outputted via the switch element 207. In the switch element 207, a control input terminal is supplied with the output sent from the memory element 206, one terminal is supplied with a reference voltage Vref of the reference lines 205, and the other terminal is supplied with a common voltage Vcom of the counter electrode 216, which is sent from the pixel electrode 1 via a liquid crystal layer 215. Thus, a resistance value of the switch element 207 from one terminal to the other terminal is controlled in response to the memory element 206 so as to adjust a bias state of the liquid crystal layer 215.

In the arrangement shown in FIG. 15, a positive feedback memory circuit, namely a static type memory element, is employed, using two stages of invertors 212 and 213 composed of Poly-Si (polysilicon) TFTs. Here, when a scanning voltage Vg of the scanning line 203 turns to High so as to select the scanning line 203, a TFT 211 is switched ON. At this point, a signal voltage Vsig sent from the signal line 204 is supplied to a gate terminal of the inverter 212 via the TFT 211. The output of the inverter 212 is inverted by the inverter 213 and is supplied again to the gate terminal of the inverter 212. Thus, the data written into the inverter 212 while the TFT 211 is ON are fed back to the inverter 212 in the same polarity so as to be held until the TFT 211 is switched ON again. As explained above, the publication discloses an arrangement in which one static type memory element is provided for each pixel of the liquid crystal display device.

Another arrangement for providing a static type memory element made of the polysilicon TFTs to each pixel is disclosed in U.S. Pat. No. 4,996,523 (corresponding to Japanese Unexamined Patent Publication No. 2-148687/1990 (Tokukaihei 2-148687, published on Jun. 7, 1990)). This discloses an arrangement in which a plurality of the static type memory elements are provided for each pixel composed of organic EL. FIG. 16 is a circuit diagram showing an arrangement of each pixel section in the conventional technique. In the conventional technique, each pixel is composed of (a) a plurality of memory cells m1, m2, . . . , and mn (n=4 in FIG. 16), (b) a constant electric current circuit 225, (c) transistors q1 through qn respectively controlled by data sent from each of the memory cells m1 through mn, so as to generate a reference electric current of the constant electric current circuit 225, and (d) an organic EL element 226 driven by the electric current sent from the constant electric current circuit 225. The memory cells m1 through mn corresponding to the same pixel are commonly supplied with a low electrode control signal v1, and respectively supplied with n-bit column electrode control signals b1 through bn.

The constant electric current circuit 225 is a current mirror circuit using TFTs 223 and 224. For this reason, the electric current flowing through the organic EL element 226 is determined by the reference electric current, namely a sum of all electric current flowing through the transistors q1 through qn which are connected in parallel with each other. The electric current flowing through the transistors q1 through qn is set by gate voltages of the transistors q1 through qn determined by the data stored in the memory cells m1 through mn.

As shown in FIG. 17, for example, each of the memory cells m1 through mn is so arranged to be provided with (a) a CMOS inverter 228 for inverting the input of the low electrode control signal v1, (b) a holding CMOS inverter 230, (c) a feedback CMOS inverter 231, and (d) MOS transmission gates 227 and 229 for controlling which one of the column electrode control signals b1 through bn and the output of the feedback inverter 231 is supplied to a gate of the holding inverter 230 in response to the low electrode control signal v1 and the inverting CMOS inverter 228. Thus, while the low electrode control signal v1 is selected, the MOS transmission gate 227 is turned ON and the MOS transmission gate 229 is turned OFF, so that a column input signal Bn is supplied to the gate of the CMOS inverter 230 via the MOS transmission gate 227. On the other hand, while the low electrode control signal v1 is not selected, the MOS transmission gate 227 is turned OFF and the MOS transmission gate 229 is turned ON, so that the output of the CMOS inverter 231 is fed back to the CMOS inverter 230 via the MOS transmission gate 229. Thus, the memory cells m1 through mn respectively have an arrangement of a static type memory element in which the output of the CMOS inverter 230 is fed back to the gate of the CMOS inverter 230 via the CMOS inverter 231 and the MOS transmission gate 229.

As described above, U.S. Pat. No. 4,996,523 discloses the arrangement in which the plurality of static type memory elements are provided for each pixel of the organic EL display device. Note that, in a display device using the polysilicon substrate, a driver circuit for driving the electro-optic element also can be formed with the polysilicon TFTs.

However, in the conventional technique described in Tokukaihei 8-194205, one pixel is composed of the liquid crystal layer 215, the switch element 207 for driving the liquid crystal, and the 1-bit memory element 206, as shown in FIG. 15. This causes a problem that one liquid crystal element can display only a binary monochrome image using the memory element 206, but cannot display an image having more than two tone gradations. Another problem is that these memory elements 206 can display still images, but cannot display moving images. As a result, in the conventional technique disclosed in Tokukaihei 8-194205, a scale of the driver circuit arranged around a display screen for displaying multiple tone gradations and moving images is the same as that in a display device in which the memory elements are not provided in the pixels. Namely, the scale of the driver circuit cannot be made smaller.

In this respect, when tone gradations are displayed using the plurality of static type memory elements m1 through mn arranged in each pixel as in the conventional technique disclosed in U.S. Pat. No. 4,996,523, the plurality of memory elements carry out D/A conversion when multiple tone gradations or moving images are displayed, thereby eliminating a need of the D/A converting circuit in a driver circuit. This allows the scale of the driver circuit arranged around the display screen to be made smaller.

However, as shown in FIG. 17, each of the memory elements m1 through mn uses ten TFTs, thereby causing a problem that too many TFTs are required for displaying the tone gradations. Here, it is assumed that each of the memory elements m1 through mn is composed of a total of six TFTs including two inverters and two selecting TFTs. In this case, the number of the TFTs per pixel required for displaying 4-bit tone gradations is calculated as follows; the number of TFTs required per memory cell multiplies the bit number, namely the number of the TFTs required per memory cell (6)×the bit number (4 bits)=24. Further, additional TFTs are required for displaying the tone gradations, as shown in FIG. 16.

Here, in a display device having definition of approximately 100 DPI (dot/inch), for example, the pixel size is a 250 μm square. Since three RGB colors of dots are required to be arranged in the pixel size, it is quite difficult to provide the above-calculated number of TFTs per one dot in a polysilicon process of a present design rule (4 to 2 [μm] rule).

On the other hand, in an arrangement of a dynamic type memory element in which a condenser is used as the memory element, the memory element can be arranged with a smaller number of TFTs, requiring approximately one or two TFTs per 1 bit of the memory element. However, a problem is that the dynamic type memory element cannot store and display still images, because electric charges stored in the condenser are lost through leakage electric current.

SUMMARY OF THE INVENTION

The object of the present invention is to provide a display device and a display method able to reduce the number of TFTs required per 1 bit of memory element and able to reduce a scale of a driver circuit arranged around a display screen.

The present invention relates to a display device in which electro-optic elements are arranged in a matrix, each of the electro-optic elements being arranged in a vicinity of an intersection of a data line and a gate line, and a plurality of storage elements (memory elements) are arranged corresponding to each of the electro-optic elements, and a display method using the display device. The display device of the present invention is so arranged that the plurality of storage elements are composed of a condenser which is a potential holding section. The display device of the present invention is also arranged so as to include a buffer circuit to which a potential of the condenser is supplied for recharging the potential of the condenser with an output potential of the buffer circuit.

In order to attain the foregoing object, a display device of the present invention is characterized by including (a) electro-optic elements arranged in a matrix, each of the electro-optic elements being arranged in a vicinity of an intersection of a first line and a second line, (b) a potential holding section for holding a potential so as to drive and display the electro-optic element, (c) a buffer circuit for outputting a potential supplied from the potential holding section, (d) a first switching element provided in series with the potential holding section, and (e) a second switching element provided between (1) the first switching element or the potential holding section and (2) the first line, which is switched ON and OFF by the second line, wherein a plurality of the potential holding sections are provided with respect to each of the electro-optic elements, and the plurality of potential holding sections are connected to an output terminal of the buffer circuit.

In order to attain the foregoing object, another display device of the present invention is characterized by including (a) electro-optic elements arranged in a matrix, each of the electro-optic elements being arranged in a vicinity of an intersection of a first line and a second line, (b) a potential holding section for outputting a potential so as to drive and display the electro-optic element, (c) a buffer circuit for outputting a potential supplied from the potential holding section, (d) a first switching element provided between (1) each of the electro-optic elements or the buffer circuit and (2) the potential holding section, and (e) a second switching element provided between the first switching element and the first line, which is switched ON and OFF by the second line, wherein a plurality of the potential holding sections are provided with respect to each of the electro-optic elements, and output terminals of the plurality of potential holding sections are connected to an output terminal of the buffer circuit.

With this arrangement, a dynamic type memory element can be used as a pseudo static type memory element, thereby reducing the number of TFTs required for composing the pixel in comparison to an arrangement where the static type memory element is used. As a result, it is possible to reduce the required number of TFTs in comparison to a case where the static type memory element is incorporated in the pixel as the memory element. Further, the plurality of memory elements are incorporated in the pixel as described above, thereby reducing the scale of the driver circuit arranged around the display screen, which is required for displaying moving images or tone gradations. As a result, it is possible to provide a display device having a smaller scale of the driver circuit in comparison to an arrangement where the pixel does not incorporate the plurality of memory elements.

More specifically, the second switching element realized by the TFT, etc., is provided between the potential holding means and the first line which is the data line. Thus, by controlling the second switching element, a potential supplied from the first line can be supplied to the potential holding means. Therefore, pixel circuits can be arranged in a matrix, each of the electro-optic elements being arranged in a vicinity of each of the intersections of the first line as the data line and the second line as the gate line.

Further, the output terminal of the buffer circuit and the output terminal of the potential holding section are connected directly, or indirectly, namely via source and drain terminals of the switching element. Thus, the potential holding section can be recharged with the output potential of the buffer circuit. Therefore, it is possible to use the dynamic type memory element as the pseudo static type memory element.

Here, a plurality of the potential holding sections realized by the condenser, etc., are provided with respect to one electro-optic element, and the first switching element is provided between the plurality of potential holding sections and the electro-optic element. Thus, by controlling the first switching element, it is possible to switch the potential holding sections. Further, when the potential held in the potential holding section is supplied to the buffer circuit, the potential of the potential holding section and the output potential of the buffer circuit are supplied to the buffer circuit in combination.

Incidentally, the first switching element is generally provided between (1) the potential holding section and (2) the electro-optic element or the buffer circuit, but the potential holding section can be provided between (1) the first switching element and (2) the electro-optic element or the buffer circuit, since electric charges of the condenser cannot transfer when one of the terminals of the condenser turns to an open state.

Here, in order to prevent the input potential of the buffer circuit from being affected by the output potential of the buffer circuit, it may be arranged so as to increase capacitance of the potential holding section or an output resistance of the buffer circuit. Alternatively, a third switching element realized by the TFT, etc., may be provided so as to separate the output terminal and the input terminal of the buffer circuit while the potential holding sections are switched.

Incidentally, the buffer circuit and the static type memory element are generally composed of two inverter circuits. The structure of the present invention can be applied to an arrangement in which one potential holding section is provided with respect to one electro-optic element, but in this arrangement, the number of TFTs for composing the driver circuit is the same as that in the arrangement where the static type memory element is used. However, the beneficial features of the display device of the present invention can be appreciated in the arrangement in which the plurality of potential holding sections are provided with respect to one electro-optic element, because the required number of TFTs for composing a driver circuit per 1 bit can be reduced in comparison to a case where the display device is arranged with a plurality of static type memory elements.

As a result, with the structure of present invention as described above, it is possible to provide a display device able to reduce the number of TFTs required per potential holding section, namely per 1 bit of the memory element and able to reduce the scale of the driver circuit arranged around the display screen.

A display method of the present invention using the display device is characterized by including the steps of (a) setting the potential of the potential holding section corresponding to a potential of the first line, while the second switching element is ON, (b) applying the potential of the potential holding section to an input terminal of the buffer circuit so as to recharge the potential holding section with the output of the buffer circuit corresponding to the applied potential, while the second switching element is OFF, and (c) controlling a display state of the electro-optic element in response to one of the potential holding section and the buffer circuit.

More specifically, a source terminal of the second switching element is connected to the first line, namely the data line, whereas a gate terminal of the second switching element is connected to the second line, namely the gate line. In the step (a), while the second switching element is ON, the potential of the data line is supplied via the drain terminal, and a potential corresponding to the supplied potential is held in the potential holding section. In the step (b), while the second switching element is OFF, the potential of the potential holding section is supplied to the buffer circuit, and then the output of the buffer circuit recharges the potential holding section, thus enabling the potential to be held. In the step (c), the display state of the electro-optic element is controlled in response to the potential holding section or the buffer circuit. Note that, the step (b) and the step (c) are often simultaneously carried out.

Therefore, tone gradations can be displayed by using the dynamic type memory element as the pseudo static type memory element. As a result, it is possible to display tone gradations using a display device composed of a smaller number of TFTs.

Note that, in a display device having an arrangement in which a buffer circuit is provided to each pixel, the display state of the electro-optic element is presumably set in accordance with the output voltages of the buffer circuit, of the potential holding section, or of the first line. On the other hand, in a display device having an arrangement in which a buffer circuit is provided with respect to a plurality of pixels, the display state of the electro-optic element is presumably set in accordance with the output voltages of the potential holding section or of the first line.

For a fuller understanding of the nature and advantages of the invention, reference should be made to the ensuing detailed description taken in conjunction with the accompanying drawings.

BRIEF DESCRIPTION OF THE DRAWINGS

FIG. 4(*a*) shows a case where the moving images are displayed without dividing upper bits, whereas FIG. 4(*b*) shows a case where the moving images are displayed with dividing the upper bits.

FIG. 18(*a*) is an explanatory diagram showing a structure of Alq used as an electron transportation layer, FIG. 18(*b*) is an explanatory diagram showing a structure of Zn(oxz)2 used as a dopant of Alq which is a light emitting layer, FIG. 18(*c*) is an explanatory diagram showing a structure of DCM used as a dopant of Alq which is the light emitting layer, FIG. 18(*d*) is an explanatory diagram showing a structure of TPD used as a hole transportation layer, and FIG. 18(*e*) is an explanatory diagram showing a structure of CuPc used as a hole entering layer.

DESCRIPTION OF THE EMBODIMENTS

The present invention relates to a display device in which a memory element is provided for each pixel and in particular to a display device having a simplified driver circuit structure by providing the memory element in the pixel, and to a display method (driving method) using the display device. Thus, the display device of the present invention is preferably provided with TFTs (Thin Film Transistors) formed by using a polysilicon process which can manufacture the driver circuit with the TFTs.

Therefore, a process for manufacturing the TFTs used in the present embodiment may be the polysilicon process, and in particular a CGS (Continuous Grain Silicon) TFT manufacturing process which is a typical example, or a polysilicon (Poly-Si) TFT manufacturing process which is generally used. Note that, the CGSTFT manufacturing process is described in Japanese Unexamined Patent Publication Nos. 8-204208/1996 (Tokukaihei 8-204208, published on Aug. 9, 1996) and 8-250749/1996 (Tokukaihei 8-250749, published on Sep. 27, 1996), for example, and thus detailed explanation thereof will be omitted here.

First Embodiment

The following will explain an embodiment of the present invention with reference to FIGS. 1 through 5.

Figure 2:
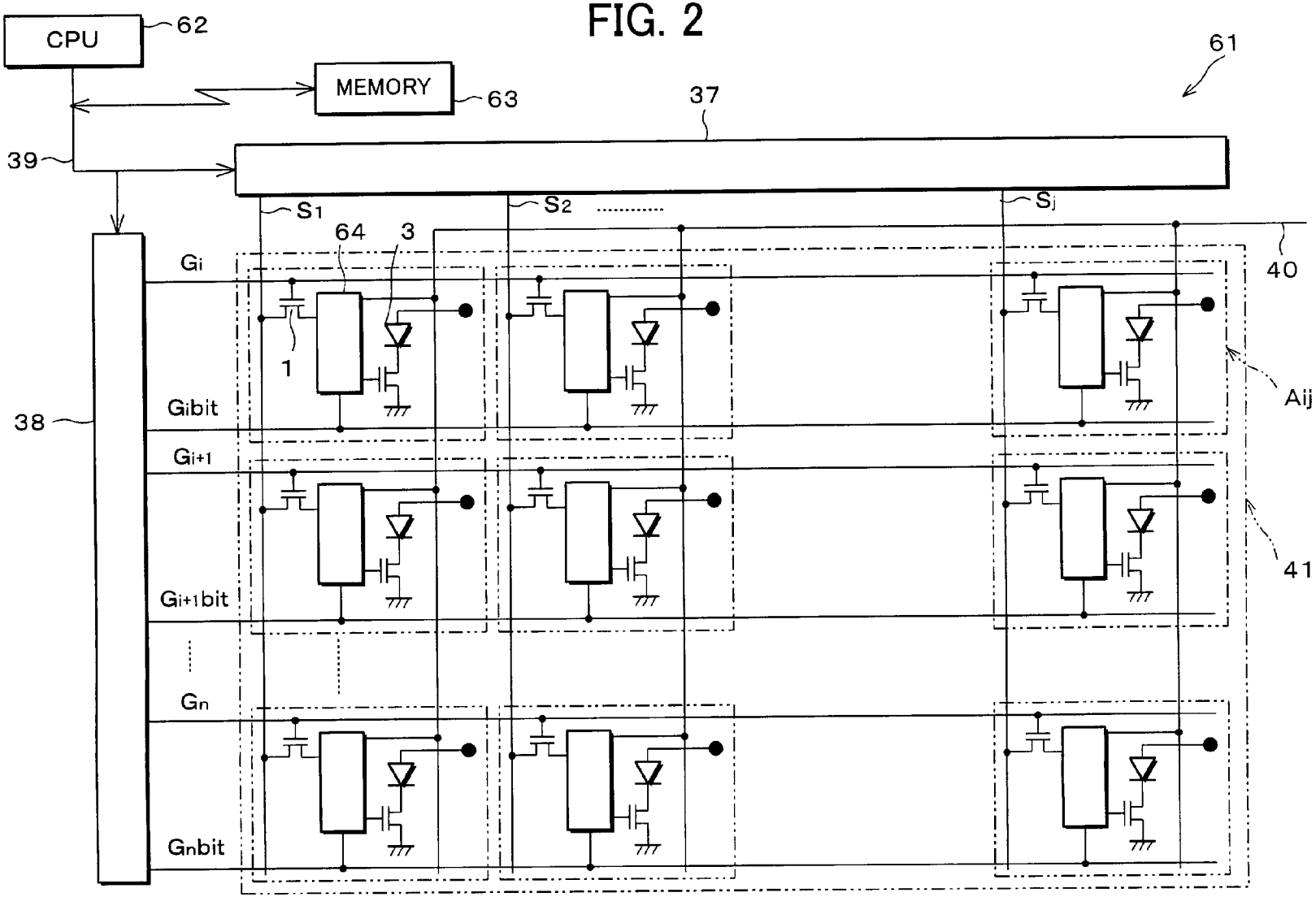
FIG. 2 is an explanatory diagram schematically showing an arrangement of the display device of the first embodiment.

FIG. 2 schematically shows an overall arrangement of a display device 61 of the present embodiment. As shown in FIG. 2, the display device 61 of the present embodiment is an EL display provided with a display screen 41 having an organic EL element (electro-optic element) 3 as an electro-optic element, but a liquid crystal element or an FED element may be used as the electro-optic element instead of the organic EL element 3.

In the display device 61 of the present embodiment, an input signal (a data signal and a synchronizing signal) sent from a CPU (Central Processing Device) 62 is supplied to a source driver circuit 37 and to a gate driver circuit 38 via a line 39. The CPU 62 exchanges data with a memory element 63 which is a flash memory and SRAM (Static Random Access Memory), and supplies the source driver circuit 37 with the data signal of the data to be displayed.

Then, in the source driver circuit 37, the inputted data signal is received by a shift register (not shown), and transferred to a latch circuit (not shown) in accordance with a timing of the inputted synchronizing signal. The bit data held in the latch circuit is transferred to the display screen via a data line Sj. Further, in accordance with the synchronizing signal supplied from the CPU 62 via the input signal line 39, the gate driver circuit 38 outputs a synchronizing signal, etc., to a gate line Gi (i=1, 2, . . . , n), and controls an n-type TFT 1 so that an appropriate pixel Aij receives a voltage outputted to the data line Sj (j=1, 2 . . . , n).

Further, the gate driver circuit 38 is provided with a control line Gi (i=1, 2, . . . n) bitx (x=1, 2, 3, 4) for controlling a circuit 64 including a plurality of switching elements, a condenser, and a buffer circuit (not shown). The circuit 64 is supplied with a power supply voltage VDD from a power supply line 40.

Figure 1:
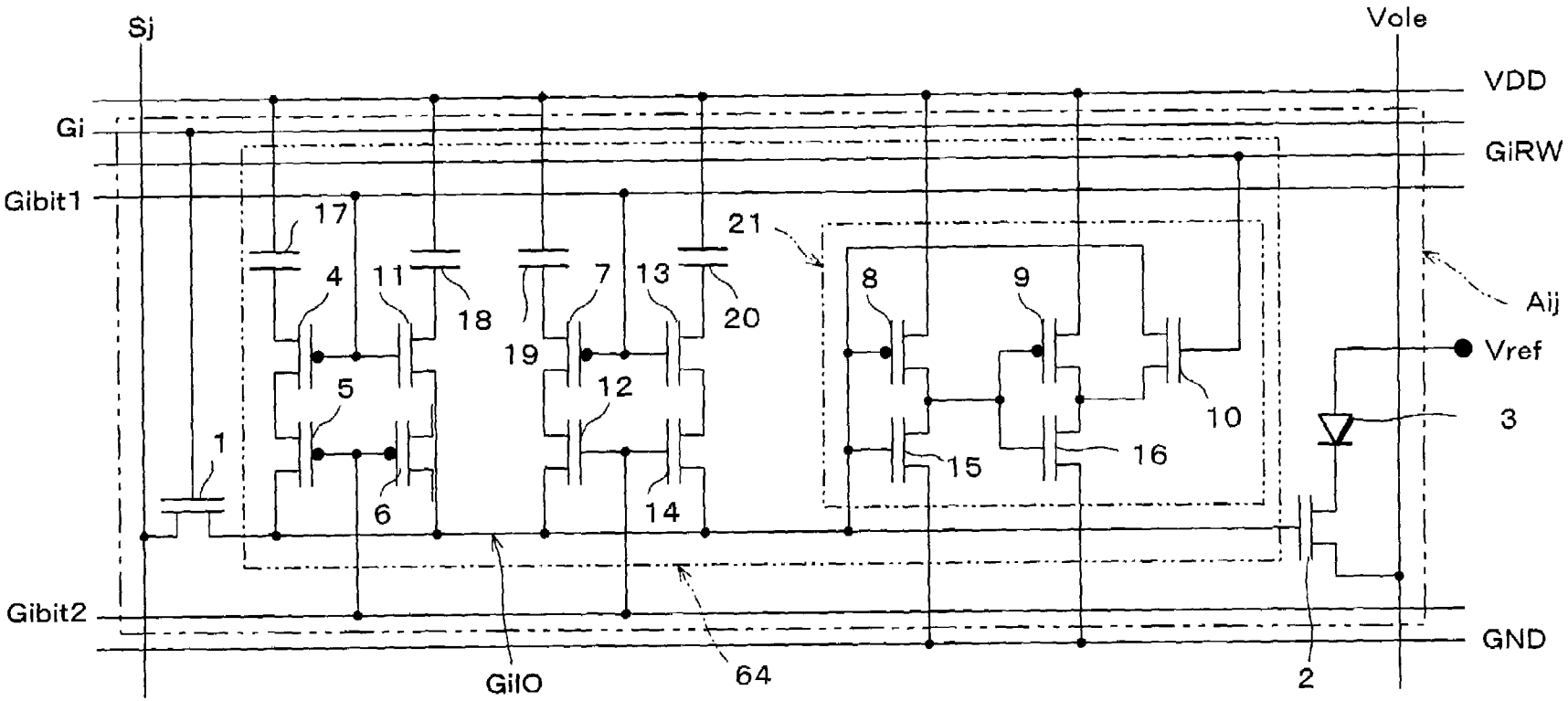
FIG. 1 is a circuit diagram showing a structure of a pixel circuit of each pixel section in a display device of a first embodiment of the present invention.

FIG. 1 shows an arrangement of a pixel circuit (an equivalent circuit) of the pixel Aij which is arranged in a vicinity of an intersection of the data line (a first line) Sj and the gate line (a second line) Gi. The pixel circuit performs display operations in response to the source driver circuit 37 and the gate driver circuit 38. The electro-optic element of the pixel is composed of the organic EL element 3 and an n-type TFT 2 having a source terminal connected to a negative pole of the organic EL element 3. A drain terminal of the n-type TFT 2 is connected to a power supply line Vole, whereas a positive pole of the organic EL element 3 is applied with a counter electrode voltage Vref. Further, a gate terminal of the n-type TFT 2 is connected with a drain terminal of the n-type TFT 1 (a second switching element). Hereinafter, a line between the drain terminal of the n-type TFT 1 and the gate terminal of the n-type TFT 2 is referred to as GiIO.

A source terminal of the n-type TFT 1 is connected with the data line Sj which is the first line, whereas a gate terminal of the n-type TFT 1 is connected with the gate line Gi which is the second line. Further, the drain terminal of the n-type TFT 1 is connected with p-type TFTs 4 through 7 and n-type TFTs 11 through 14 which are first switching elements, and thus indirectly connected to condensers 17 through 20 which are potential holding means via these TFTs. The drain terminal of the n-type TFT 1 is further connected to a buffer circuit 21. In other words, the line GiIO is connected with the condensers 17 through 20 and with the buffer circuit 21.

The buffer circuit 21 of the present embodiment is composed of a first inverter circuit including a p-type TFT 8 and an n-type TFT 15, and a second inverter circuit including a p-type TFT 9 and an n-type TFT 16. The drain terminal (the line GiIO) of the n-type TFT 1 is connected to an input terminal of the first inverter circuit, and an output terminal of the first inverter terminal is connected to an input terminal of the second inverter circuit.

Further, an output terminal of the second inverter circuit and an input terminal of the first inverter circuit, both of which compose the buffer circuit 21, are connected to a source terminal and a drain terminal of an n-type TFT 10 (a third switching element), respectively.

In the present embodiment, for showing a desirable arrangement of the present invention, explained as an embodiment is the pixel circuit in FIG. 1 which is provided with the plurality of condensers 17 through 20, and the p-type TFTs 4 through 7 and the n-type TFTs 11 through 14 which are the first switching elements. The display device of the present invention, however, can be operated when only one condenser is provided to the pixel circuit of the pixel Aij, namely when the first switching element is not provided. However, a static memory can be arranged with the similar number of TFTs used in the buffer circuit 21 where four or five TFTs are used. In this respect, the beneficial features of the display device of the present invention can be appreciated in its application to the structure wherein the plurality of condensers are provided.

Further, in the present embodiment, for explaining a desirable arrangement of the present invention, the n-type TFT 10 as the third switching element is provided in the buffer circuit 21. In the present invention, however, when capacitances of the condensers 17 through 20 are sufficiently large, the n-type TFT 10 needs not be provided. In other words, if the output of the second inverter circuit does not vary potential of the condensers 17 through 20, the n-type TFT 10 is not required. Whether the n-type TFT 10 is required or not is determined by a relative value of an output impedance of the second inverter circuit and the capacitances of the condensers 17 through 20. Thus, the output impedance of the second inverter circuit may be increased instead of increasing the capacitances of the condensers 17 through 20. Namely, under this condition, the output terminal of the second inverter circuit may be directly connected to the input terminal of the first inverter circuit in the buffer circuit 21.

In the present embodiment, for showing a desirable arrangement of the present invention, explained is the circuit 64 of the pixel Aij, which is provided with the plurality of condensers 17 through 20, the p-type TFTs 4 through 7 and the n-type TFTs 11 through 14 as the first switching elements, and the n-type TFT 10 as the third switching element, as shown in FIG. 1.

Between the condensers 17 through 20 and the drain terminal of the n-type TFT 1 as the second switching element, the p-type TFTs 4 through 7 and the n-type TFTs 11 through 14 as the first switching elements are provided.

Note that, the electric charges of the respective condensers 17 through 20 cannot transfer when one terminals among terminals of the respective condensers 17 through 20 turns to an open state. Thus, the condensers 17 through 20 may be provided on the terminal GiIO side with respect to the p-type TFTs 4 through 7 and the n-type TFTs 11 through 14 which are the first switching elements and the n-type TFT 1. The circuit as arranged above can operate in the same way as in the arrangement shown in FIG. 1.

Note that, in the present embodiment, for convenience, the circuit structure as shown in FIG. 1 is used for explanation, in which the first switching element is provided between the condensers 17 through 20 and the drain terminal of the n-type TFT 1.

One of the terminals of the condenser 17 is connected in series with the p-type TFTs 4 and 5 using a drain terminal and a source terminal. More specifically, the drain terminal of the p-type TFT 4 is connected to the source terminal of the p-type TFT 5. Further, a gate terminal of the p-type TFT 4 is connected to a control line Gibit 1, whereas a gate terminal of the p-type TFT 5 is connected to a control line Gibit 2.

Similarly, one of the terminals of the condenser 18 is connected in series with the n-type TFT 11 and the p-type TFT 6 using a drain terminal and a source terminal. Further, a gate terminal of the n-type TFT 11 is connected to the control line Gibit 1, whereas a gate terminal of the p-type TFT 6 is connected to the control line Gibit 2.

Similarly, one of the terminals of the condenser 19 is connected in series with the p-type TFT 7 and the n-type TFT 12 using a drain terminal and a source terminal. Further, a gate terminal of the p-type TFT 7 is connected to the control line Gibit 1, whereas a gate terminal of the n-type TFT 12 is connected to the control line Gibit 2.

Similarly, one of the terminals of the condenser 20 is connected in series with the n-type TFTs 13 and 14 using a drain terminal and a source terminal. Further, a gate terminal of the n-type TFT 13 is connected to the control line Gibit 1, whereas a gate terminal of the n-type TFT 14 is connected to the control line Gibit 2.

In other words, where the potential of the control lines Gibit 2 and Gibit 1 is expressed in a form of (the potential of the control line Gibit 2, the potential of the control line Gibit 1), the line GiIO is connected to the condenser 17 at (negative selection potential, negative selection potential), to the condenser 18 at (negative selection potential, positive selection potential), to the condenser 19 at (positive selection potential, negative selection potential), and to the condenser 20 at (positive selection potential, positive selection potential), respectively. Namely, one of the condensers 17 through 20 can be selected by controlling the potential of the control lines Gibit 2 and Gibit 1. Further, a gate terminal of the n-type TFT 10 which is the third switching element is connected to a control line GiRW.

Figure 3:
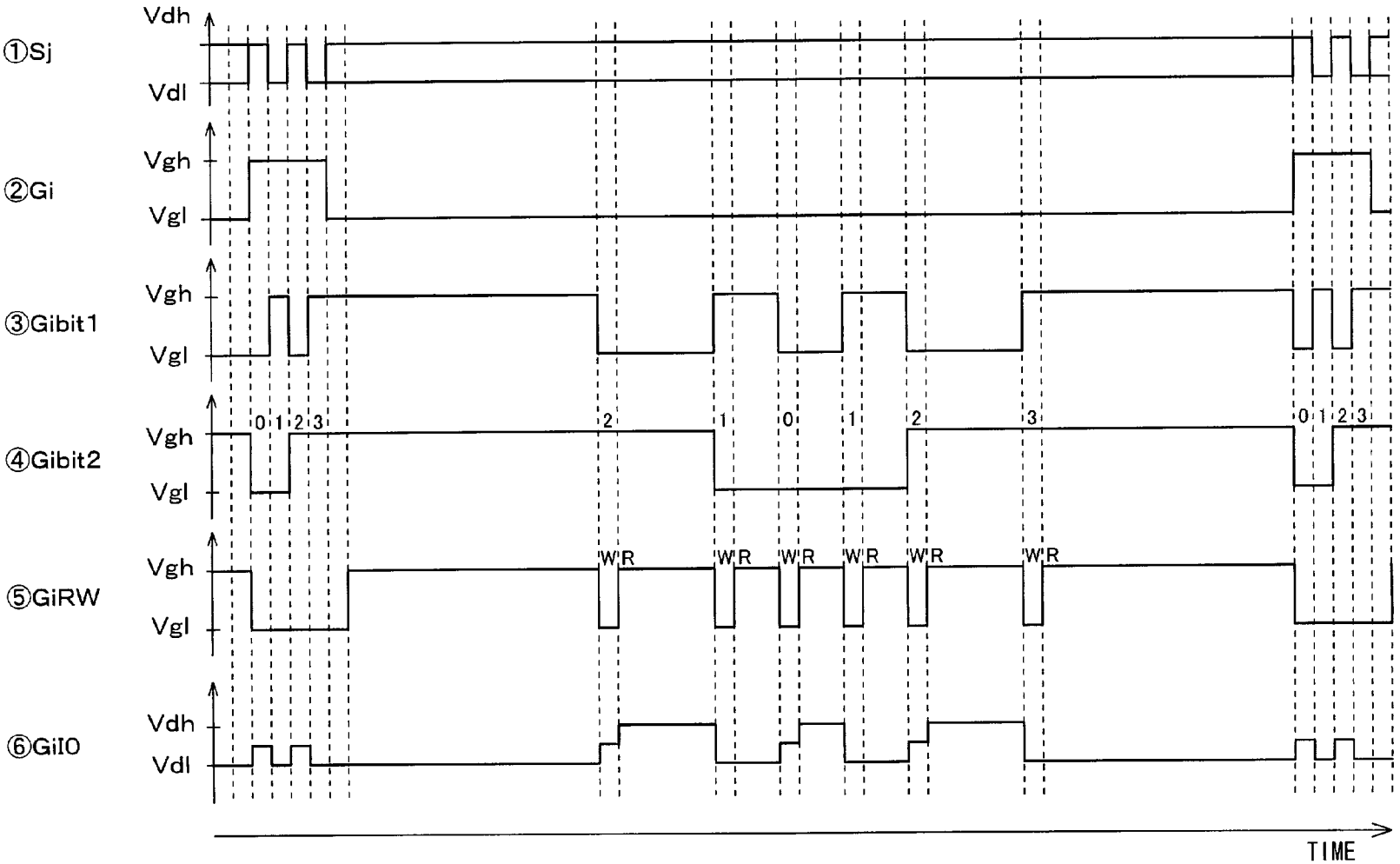
FIG. 3 is a waveform chart of a data line, a gate line and a control line in the display device, which explains operations of an electric circuit in a display method using the display device of the first embodiment.

With reference to FIG. 3, operations in a display method using the pixel circuit of the pixel shown in FIG. 1 will be explained below. As shown in FIG. 3, during a selection period (a period when ② Gi in FIG. 3 is at a potential Vgh), 4-bit tone gradation data, which are to be displayed by the pixel Aij, are transferred to the data line (① Sj in FIG. 3). Then, where the potential of the control lines Gibit 2 and Gibit 1 is expressed in the form of (the potential of ④ Gibit 2, the potential of ③ Gibit 1), the combination is sequentially varied during the selection period so as to be (negative selection potential: Vgl, negative selection potential: Vgl (hereinafter referred to as "0")), (negative selection potential Vgl, positive selection potential: Vgh (hereinafter referred to as "1")), (positive selection potential: Vgh, negative selection potential: Vgl (hereinafter referred to as "2")), and (positive selection potential: Vgh, positive selection potential: Vgh (hereinafter referred to as "3")). This allows the 4-bit tone gradation data, which have been transferred to the data line (③ Sj in FIG. 3) to be displayed by the pixel Aij, to be stored in the respective condensers 17 through 20 (see FIG. 1) during the respective periods corresponding to "0", "1", "2" and "3".

Note that, during the selection period, the control line ⑤ GiRW shown in FIG. 3 is set at a non-selection potential (Vgl in FIG. 3), namely a potential at which the n-type TFT 10 (see FIG. 1) is OFF.

Following this, during a non-selection period when ② Gi in FIG. 3 is at the potential Vgl, the control lines Gibit 2 and Gibit 1 are sequentially varied to be in an order of "3", "2", "1", "0", "1", "2" and "3" in a period ratio of 4:2:1:1:1:2:4, as shown in ③ and ④ in FIG. 3. Here, during each initial period of the above-described periods, while the control line GiRW is set at the non-selection potential, the output of the second inverter circuit composing the buffer circuit 21 is stabilized at a potential corresponding to a potential of the selected condenser. Then, the control line GiRW is set at the selection potential (Vgh in FIG. 3), namely a potential at which the n-type TFT 10 (see FIG. 1) is ON.

As described above, during each period in which the potential of the control lines Gibit 2 and Gibit 1 varies, the potential of the condensers 17 through 20 is supplied to the input terminal of the buffer circuit 21 while the control line GiRW is set at the non-selection potential. At this point, the potential of the condensers 17 through 20 is judged as a HIGH potential when the potential of the condensers 17 through 20 is higher than a binary output threshold of the binary circuit 21, whereas the potential of the condensers 17 through 20 is judged as a LOW potential when the potential of the condensers 17 through 20 is lower than the binary output threshold of the binary circuit 21. Thus, the buffer circuit 21 outputs one of the HIGH potential and the LOW potential which are the binary potential as a potential having a positive polarity.

Accordingly, after the fixing of the output potential outputted from the buffer circuit 21 as the potential having the positive polarity, it is possible to recharge the potential of the respective condensers 17 through 20 which is ON, at the HIGH potential or at the LOW potential, while the control line GiRW is set at the selection potential.

As a result, even when the still images are displayed, namely when the n-type TFT 1 as the second switching element is continuously OFF, the potential stored in the respective condensers 17 through 20 can be held by repeating the display operations per device of one frame cycle in which the control lines Gibit 2 and Gibit 1 are switched in the order of "3", "2", "1", "0", "1", "2" and "3", as shown in FIG. 3.

Further, as shown in FIG. 1, the line GiIO is connected to the gate terminal of the n-type TFT 2 which is the electro-optic element. Thus, the operations of switching the control lines Gibit 2 and Gibit 1 in the order of "3", "2", "1", "0", "1", "2" and "3" as shown in FIG. 3 also control a light emitting state of the organic EL element 3 composing the electro-optic element so as to allow the electro-optic element to display multiple tone gradations in a time division manner.

In other words, the circuit 64 composing the pixel Aij of the present embodiment allows the organic EL element 3 to perform the display operations corresponding to the condensers 17 through 20 shown in FIG. 3 for enabling the display device to display still images, thereby automatically recharging the potential of the respective condensers 17 through 20.

Incidentally, in the present embodiment, for showing an example of a desirable embodiment of the present invention, explained is the display device in which the condensers 17 through 20, namely four condensers are provided, but the number of the condensers is not limited to four.

Further, when each pixel of the display device is provided with one condenser, the electro-optic element composed of the n-type TFT 2 and the organic EL element 3 can store only two values, namely 1 bit, as in a two tone gradation display which displays only two values, for example. However, the organic EL element 3 may be displayed in such a manner that the first switching element and the n-type TFT 10 which is the third switching element are switched OFF whereas the n-type TFT 1 which is the second switching element is switched ON so as to receive the potential from the data line (or a source line) Sj which is the first line. Further, the potential of the condenser may be automatically recharged in such a manner that the second switching element is switched OFF whereas the n-type TFT 1 which is the first switching element and the n-type TFT 10 which is the third switching element are switched ON.

Further, when multiple tone gradations are displayed in the time division manner, upper 3 bits, expect for lower 1 bit, are displayed twice in one field period so as to be symmetrical with respect to the lower 1 bit, as shown in FIG. 3. This reduces pseudo contour on moving images, which generates when data having different tone gradations are displayed between adjacent pixels and a picture having the different tone gradation data moves in the images.

Figures 4A, 4B:
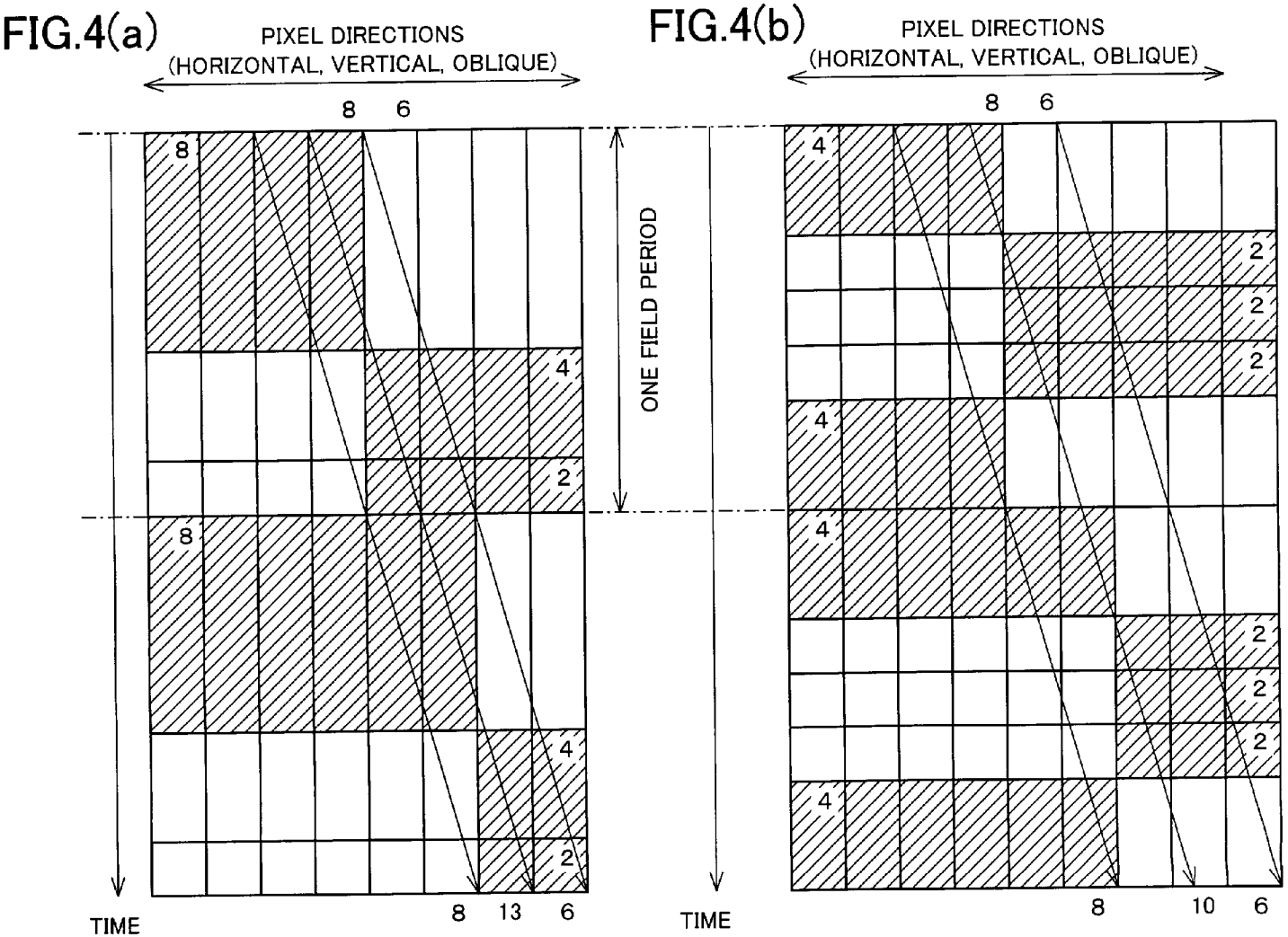
FIGS. 4(*a*) and 4(*b*) are conceptual diagrams explaining a mechanism how pseudo contour generates on moving images.

For example, when the picture having eight levels of tone gradations moves in a background having six levels of tone gradations, a sight line is taken as indicated with an arrow in FIG. 4. In this case, when the moving images are displayed without dividing the upper bits as shown in FIG. 4(*a*), a maximum of 13 levels of tone gradations may be observed at an edge of the picture, as shown at an end of the arrow in FIG. 4(*a*). This is the pseudo contour on the moving images. On the other hand, when the moving images are displayed with dividing the upper bits as shown in FIG. 4(*b*), only a maximum of ten levels of tone gradations may be observed at the edge of the picture, as shown at an end of the arrow in FIG. 4(*b*).

As described above, when multiple tone gradations are displayed in the time division manner, it is desirable to divide periods for displaying the upper bits in order to reduce the pseudo contour on the moving pictures.

Further, in the present embodiment, the organic EL element 3 has an arrangement in which (a) a negative pole such as Al, (b) an organic multilayer film, and (c) a transparent positive pole such as ITO are sequentially formed on a glass substrate. Though the organic multilayer film may have several structures, the organic multilayer film of this embodiment is so arranged that (1) Alq, etc. as an electron transportation layer, (2) Alq, etc. as a light emitting layer having DPVBi, ZN(oxz)2 and DCM as a dopant, (3) TPD as a hole transportation layer, and (4) CuPc as a hole entering layer (or a positive pole buffer layer) are sequentially layered in this order. The structures of Alq, Zn(oxz)2, DCM, TPC and CuPc are shown in FIGS. 18(*a*) through 18(*e*).

As described above, in the pixel circuit composing the display device of the present embodiment, the dynamic type memory element arranged with the condenser is recharged by the buffer circuit in accordance with the image display, thus operating in a same manner as the static type memory element. Accordingly, more memory functions can be located on each pixel using a smaller number of TFTs, namely more memory elements can be located on each pixel. In other words, it is possible to locate a desired number of memory elements on each pixel of the display device, corresponding to the number of the tone gradations to be displayed.

As a result, the source driver circuit 37 shown in FIG. 2 only needs to sequentially transfer the bit data held in the latch (not shown), as shown in ① Sj in FIG. 3. More specifically, the bit data for displaying multiple tone gradations, which are sent from the CPU 62, are received by a frame memory provided in the pixel, and then arranged so as to illuminate the organic EL element 3 for a period corresponding to weight of the respective bits. This eliminates the need of arranging a frame memory for timing conversion on a peripheral section of a panel, which is required for displaying tone gradations in the time division manner, and also eliminates the need of a D/A converting circuit, etc. which is conventionally required for the source driver circuit 37. This allows a frame section of the display panel (the peripheral section of the display screen on the display panel) to be formed quite small.

Figure 5:
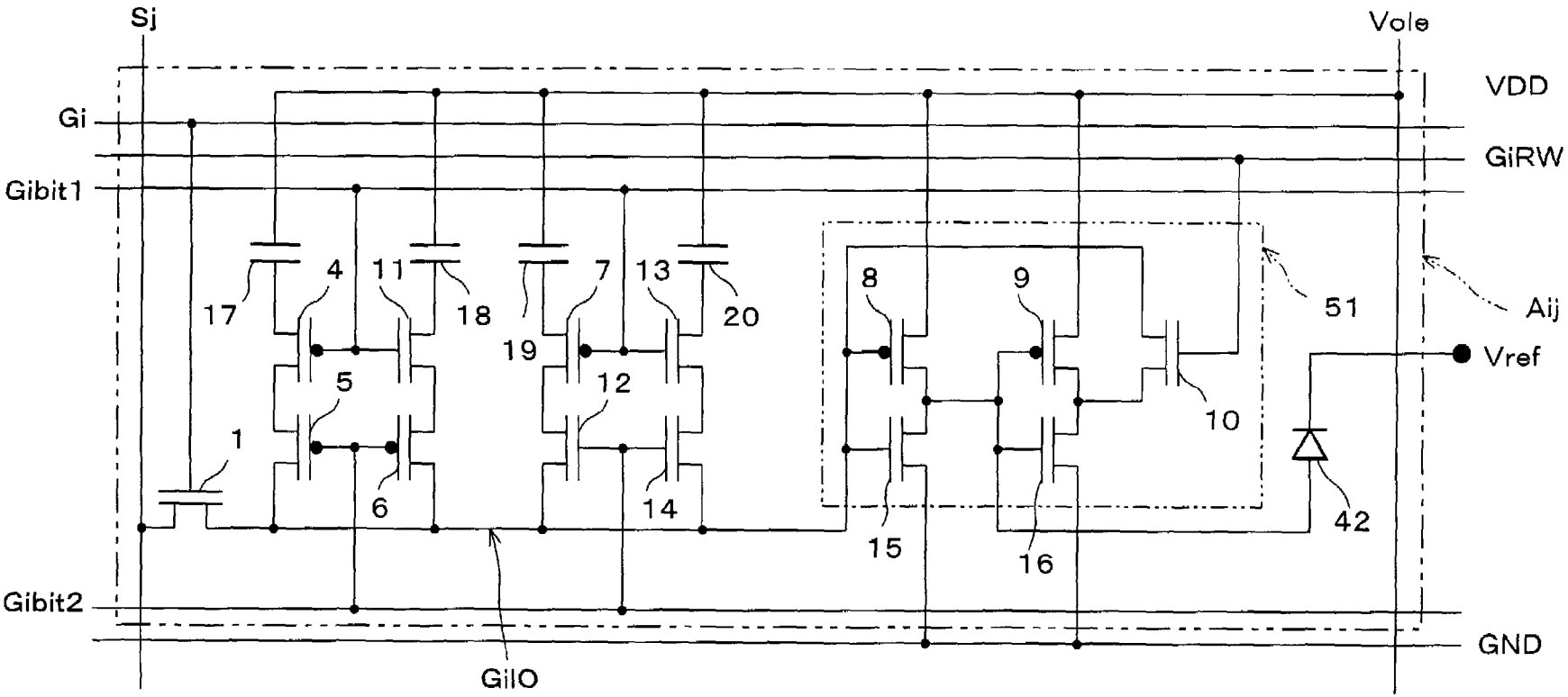
FIG. 5 is a circuit diagram showing a pixel circuit of each pixel section in the display device of the first embodiment, which is different from the pixel circuit in FIG. 1.

Note that, in FIG. 1, explained is the display device having an arrangement in which the drain terminal of the n-type TFT 1 which is the second switching element and the output terminal of the buffer circuit 21 are connected to the electro-optic element composed of the n-type TFT 2 and the organic EL element 3. In the display device of the present embodiment, however, the organic EL element 42 may be directly driven by the output of the first inverter circuit (the p-type TFT 8 and the n-type TFT 15) which is on an input terminal side of the buffer circuit 51, as shown in FIG. 5.

As described above, the display device of the present embodiment can be used not only in a case where the organic EL element 42 which is the electro-optic element is driven by the output of the buffer circuit 51, but also in a case where the organic EL element 42 is driven in response to the first inverter circuit composed of the p-type TFT 8 and the n-type TFT 15 or the second inverter circuit composed of the p-type TFT 9 and the n-type TFT 16, both of which compose the buffer circuit, and in a case where the organic EL element 42 is driven by the potential outputted from the potential holding means.

Figure 19:
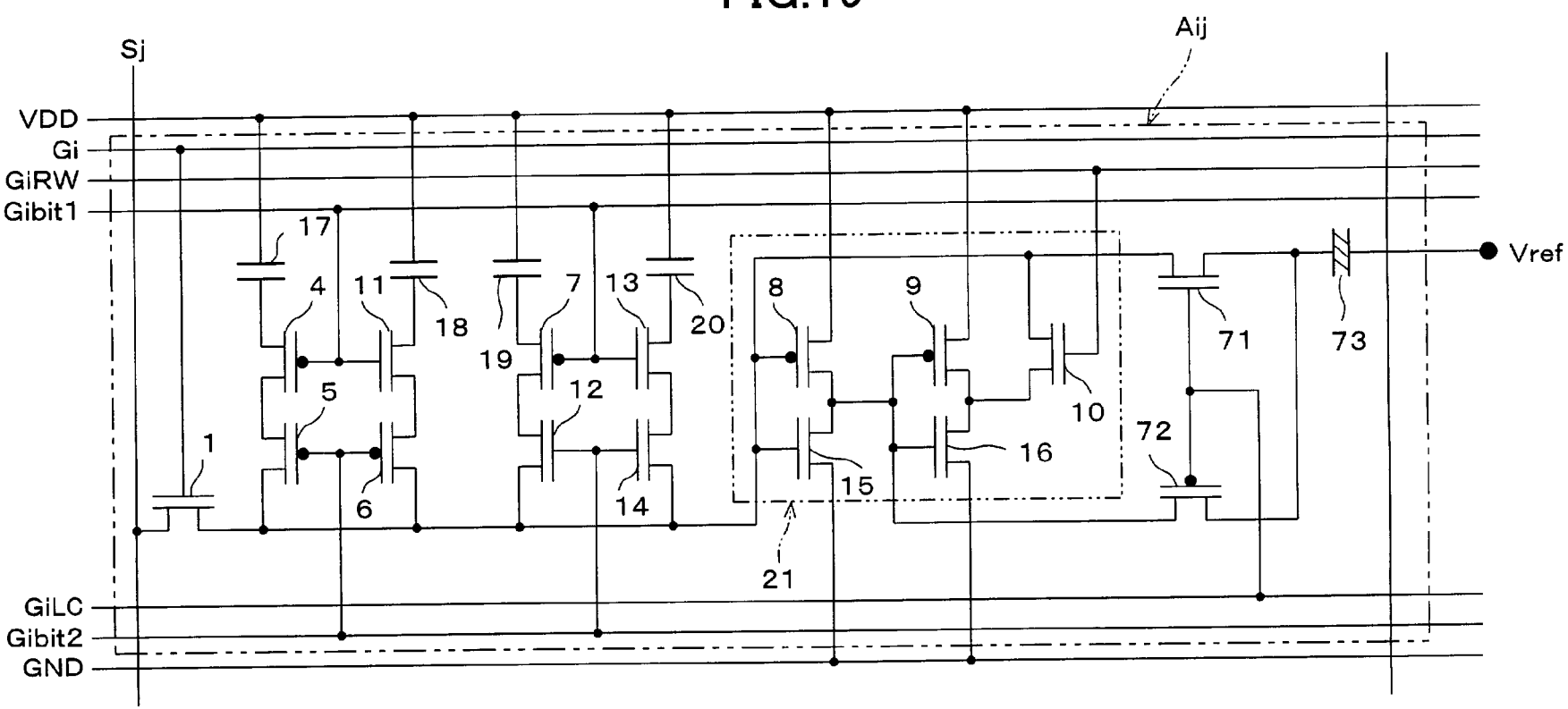
FIG. 19 is a circuit diagram showing an arrangement of a pixel circuit of each pixel where liquid crystal instead of organic EL is used as an electro-optic element in the pixel circuit of FIG. 1.

Note that, when a liquid crystal element is used as the electro-optic element, the organic EL element 3 and the n-type TFT 2 which are the electro-optic element in FIG. 1 are replaced with the liquid crystal element 73, the n-type TFT 71 and the p-type TFT 72 as shown in FIG. 19.

FIG. 19 is a circuit diagram showing an arrangement in which the liquid crystal element 73 instead of the organic EL element 3 is used as the electro-optic element in the pixel circuit of FIG. 1. More specifically, in the pixel circuit of FIG. 19, one of the terminals of the liquid crystal element 73 is connected to drain terminals of the n-type TFT 71 and the p-type TFT 72. A source terminal of the n-type TFT 71 is connected to an output terminal of the first inverter circuit composed of the p-type TFT 8 and the n-type TFT 15 in the buffer circuit 21, whereas a source terminal of the p-type TFT 72 is connected to an output terminal of the second inverter circuit composed of the p-type TFT 9 and the n-type TFT 16 in the buffer circuit 21. Thus, in accordance with each of (a) the potential Vref having a positive polarity when the n-type TFT 71 is switched ON, and (b) the potential Vref having a negative polarity when the p-type TFT 72 is switched ON, an AC potential having different polarities is applied to the liquid crystal element 73. Therefore, by switching polarities of a voltage applied to a Vref terminal of the liquid crystal element 73 in synchronism with the polarity switching of the AC potential, the liquid crystal element 73 can perform the display operations.

Figure 20:
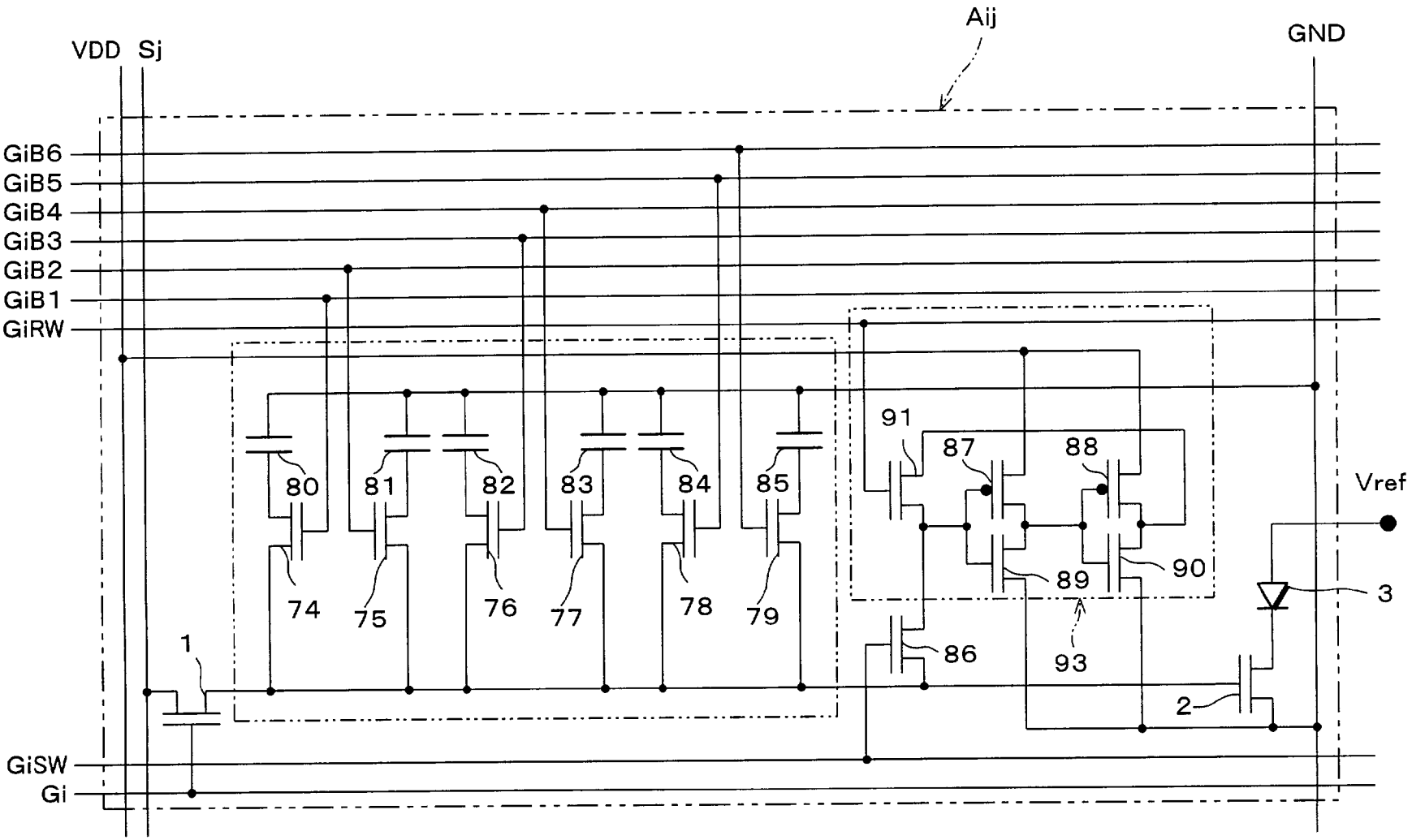
FIG. 20 is a circuit diagram showing a pixel circuit of each pixel where the organic EL is used as the electro-optic element of the display device of the first embodiment, which is different from the pixel circuit in FIG. 1.

FIG. 20 is a circuit diagram showing an arrangement of a pixel circuit of each pixel where the organic EL is used as the electro-optic element of the display device, which is different from the pixel circuit of FIG. 1. In the pixel circuit shown in FIG. 1, two of the first switching elements correspond to one potential holding means, but one first switching element may correspond to one potential holding means as in the pixel circuit shown in FIG. 20.

More specifically, each of six condensers (potential holding means) 80 through 85 corresponds to each of six n-type TFTs (the first switching elements) 74 through 79. Further, each of the six n-type TFTs 74 through 79 corresponds to control lines GiB1 through GiB6 respectively.

In this case, each of the n-type TFTs 74 through 79 can be independently controlled. Thus, even when the TFTs have different threshold properties, it is possible to control any two TFTs so as not to be simultaneously ON.

This enables capacitances of the condensers 80 through 85, which are potential holding means, to be smaller than capacitances of the condensers 17 through 21 in the arrangement of the pixel circuit shown in FIG. 1.

For example, in the arrangement of FIG. 1, when the control line Gibit 2 is in a LOW state and the control line Gibit 1 turns to a HIGH state from the LOW state, the differences in threshold potential among the TFTs may cause the p-type TFT 4 and the n-type TFT 11 to be simultaneously ON.

Therefore, capacitances of the condensers 17 and 18, which are potential holding means, are required to be large, in order to satisfy a condition that a momentary leak between the condensers 17 and 18, which are two potential holding means, does not remarkably decrease the potential of the respective condensers, namely in order to satisfy a condition that a time constant determined by (an ON resistance of the TFT)×(the capacitance of the condenser) is large.

However, in the circuit structure of FIG. 20, since it is possible to control any two TFTs among the n-type TFTs 74 through 79 so as not to be simultaneously ON, the leak does not occur between two condensers among the condensers 80 through 85. Therefore, the capacitances of the condensers 80 through 85, which are the potential holding means, need not to be larger, namely the capacitances can remain small.

Note that, a switching element 86 in FIG. 20 is provided between an amplifier circuit (a buffer circuit) 93 and the line GiIO in order to use the amplifier circuit 93 as a memory circuit.

In other words, the amplifier circuit 93 operates as a static memory circuit while the switching element 86 is OFF, whereas the amplifier circuit 93 operates as an amplifier circuit of a pseudo static memory circuit of the present invention while the switching element 86 is ON. Note that, the amplifier circuit 93 is composed of a first inverter circuit including a p-type TFT 87 and an n-type TFT 89, a second inverter circuit including a p-type TFT 88 and an n-type TFT 90, and an n-type TFT 91 which is the third switching element.

Figure 21:
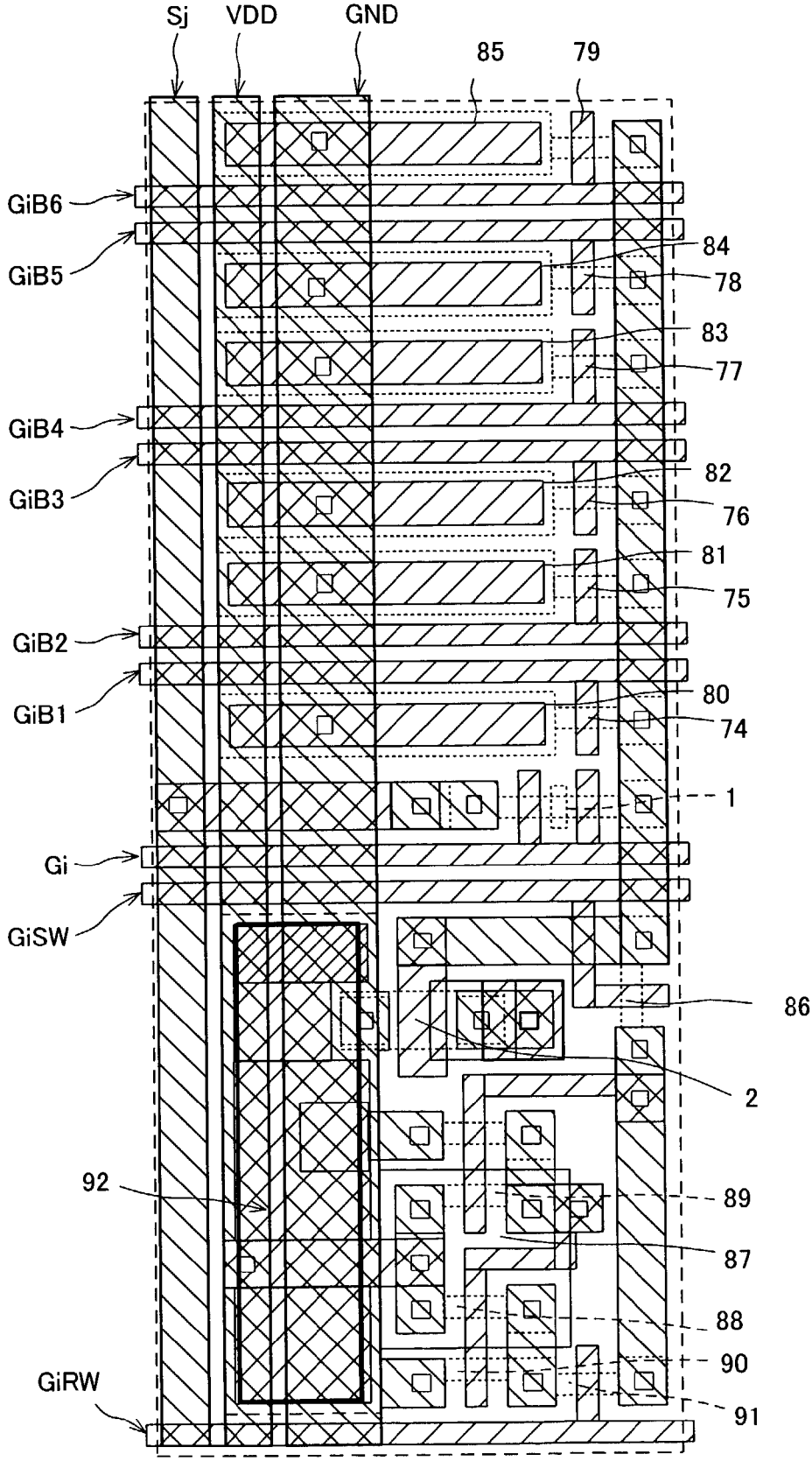
FIG. 21 is a layout diagram showing a layout arrangement in which the pixel circuit in FIG. 20 is structured as a TFT circuit.

Further, FIG. 21 is a layout diagram showing a layout arrangement of the pixel circuit of FIG. 20 where the pixel circuit is structured as a TFT circuit. An area of the pixel (a dot area) Aij, indicated with a dotted line in FIG. 21, has approximately one-third size of the pixel of a 254 μm square. As shown in FIG. 21, by using the arrangement of the pixel circuit of the present invention, 6 bits of pseudo static memory circuits shown in FIG. 20 can be arranged on the area, in spite of the present design rule (4 to 2 [μm]). Note that, in the layout of FIG. 21, a source electrode layer is indicated with the same pattern as the source line Sj, a gate electrode layer is indicated with the same pattern as the gate line Gi, and a Si layer is indicated with the same pattern (a dashed line) as the TFT 1.

Further, in the layout shown in FIG. 21, a condenser (capacitive coupling means) 92 is provided between a power supply line VDD and a GND line. In the layout of FIG. 21, the power supply line VDD serves as a power supply of the TFTs 87 and 88 composing the amplifier circuit 93, via the gate electrode layer. The Si layer under the gate line Gi is short-circuited to the GND line so as to form the condenser 92 between the power supply line VDD and the GND line.

As described above, when structuring a switching circuit such as the amplifier circuit, the condenser as the capacitive coupling means is formed between the power supply line VDD and the GND line. This enables the condenser, which couples capacitances between the power supply line VDD and the GND line of the switching circuit, to supply necessary electric charges for switching, thus effectively preventing noise and faulty operation.

Second Embodiment

Figure 6:
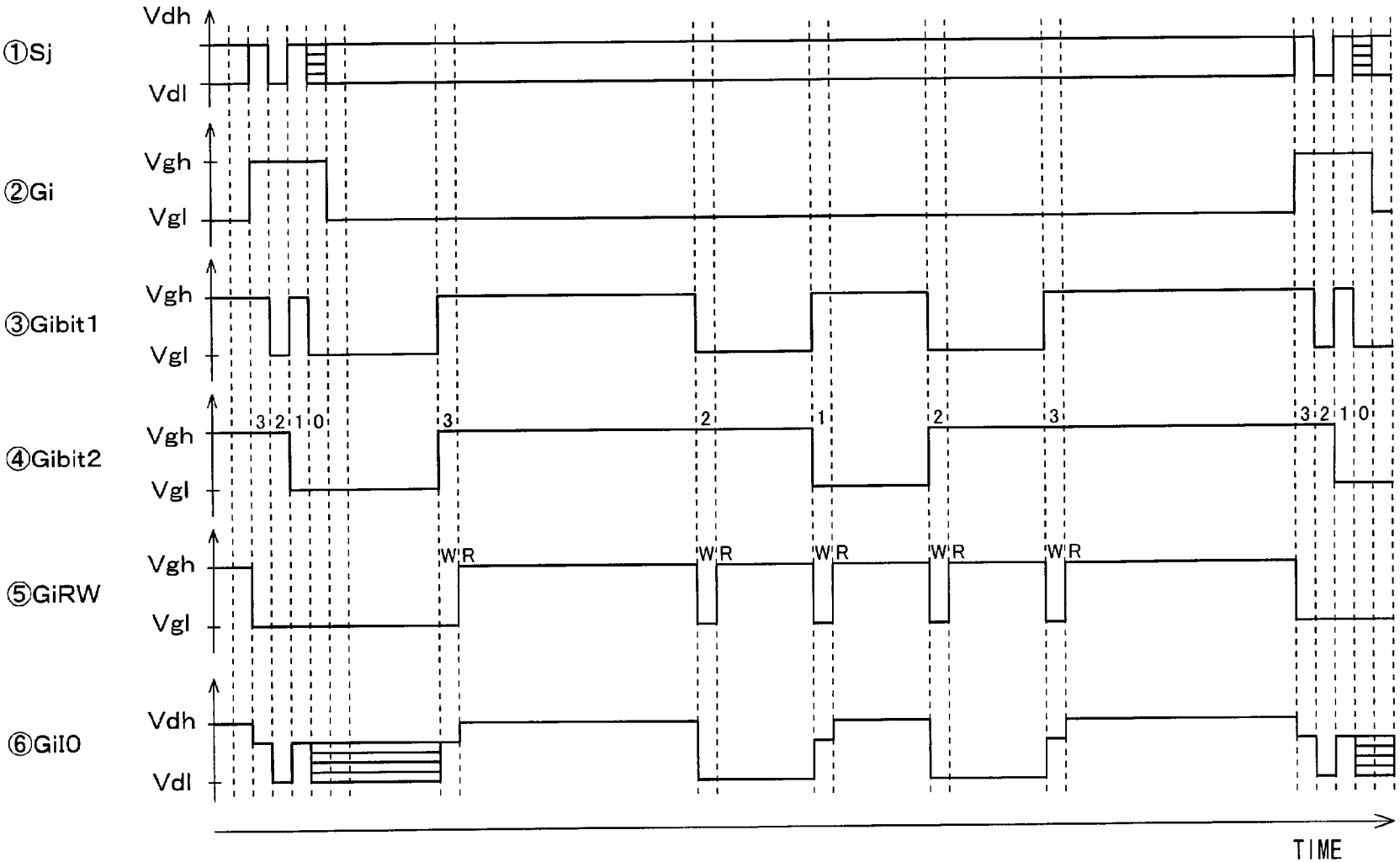
FIG. 6 is a waveform chart of a data line, a gate line and a control line in a display device, which explains operations of an electric circuit in a display method using a display device of a second embodiment of the present invention.

The following will explain another embodiment of the present invention with reference to FIGS. 1, 2 and 6. FIG. 6 shows a display method using the pixel circuit of FIG. 1, which is different from the display method explained with reference to FIG. 3 in the first embodiment. Provided with only four condensers, the pixel circuit having the arrangement shown in FIG. 1 cannot display images having more than 4 bit=16 tone gradations.

However, it is assumed here that the pixel circuit having the arrangement shown in FIG. 1 displays 64 tone gradations, and the method thereof will be examined. The following will explain a display method where the number of the memory elements m (m=4 in FIG. 1) arranged in the pixel is smaller than the bit number n (n=6 in 64 tone gradations) corresponding to the number of tone gradations to be displayed.

In the display method of the present embodiment, by a condenser for displaying tone gradation data having the least weight, lower data which could not be held in other condensers are held as a multi-valued analog potential, so as to display images having the desired number of tone gradations to be displayed.

More specifically, in the display method of the present embodiment, as shown in FIG. 6, where the potential of the control lines Gibit 2 and Gibit 1 is expressed in the form of (the potential of ④ Gibit 2, the potential of ③ Gibit 1), the combination is sequentially varied during the selection period (a period when ② Gi in FIG. 6 is at the potential Vgh) to be (positive selection potential: Vgh, positive selection potential: Vgh), (positive selection potential: Vgh, negative selection potential: Vgl), and (negative selection potential: Vgl, positive selection potential: Vgh).

In other words, the potential of the control lines Gibit 2 and Gibit 1 is sequentially varied to be in an order of "3", "2", "1", "0", so as to record upper 3-bit data as binary potential data in the condensers 18 through 20 shown in FIG. 1. Then, during the selection period, the potential of the control lines Gibit 2 and Gibit 1 is varied to be "0", namely (the potential of ④ Gibit 2, the potential of ③ Gibit 1) is at (negative selection potential: Vgl, negative selection potential: Vgl) as shown in ④ and ③ in FIG. 6, so as to allow the condenser 17 in FIG. 1 to hold the multi-valued potential data.

The multi-valued potential data are 8-level potential corresponding to remaining lower 3 bits among 6 bits required for displaying 64 tone gradations. Then, by providing the 8-level potential to the gate terminal of the n-type TFT 2 composing the electro-optic element in FIG. 1 and controlling an ON resistance of the n-type TFT 2, electric current flowing through the organic EL element 3 can be controlled so as to display the multi-valued data.

Following this, during a period when the n-type TFT 1 is not selected (a period when ② Gi in FIG. 6 is at the potential Vgl), the potential of the control lines Gibit 2 and Gibit 1 is sequentially varied from "0" to be in an order of "3", "2", "1", "2" and "3" as shown in FIG. 6, so as to turn the electro-optic element from a state for displaying the multi-valued potential data to a display state corresponding to the binary potential data stored in the condensers 18 through 20.

Note that, while the control lines Gibit 2 and Gibit 1 are "0", the control line GiRW is set at a non-selection potential (negative selection potential: Vgl) as shown in ⑤ in FIG. 6 so as to switch OFF the n-type TFT 10 which is the third switching element. This prevents the output of the buffer circuit 21 from returning to the condenser 17.

By displaying tone gradations in the above-described method, the eight levels of tone gradations, which are displayed using the analog potential stored in the condenser 17, can be added to the 3-bit levels of tone gradations, which are displayed in the time division manner, thus allowing the electro-optic element to display a total of 6-bit tone gradations (=64 tone gradations).

Note that, as shown in FIG. 6, a period when the control lines Gibit 2 and Gibit 1 are "0" is set to be ⅞ times as a period when the control lines Gibit 2 and Gibit 1 are "1". Thus, the period of "0" is set shorter than the period of "1". This guarantees the maximum level of analog tone gradations displayed using the condenser 17 is smaller than the minimum level of digital tone gradations displayed using the condensers 18 through 20.

As described above, when the analog tone gradations and the digital tone gradations are used together, it is preferable that the minimum level of digital tone gradations is guaranteed to be larger than the maximum level of analog tone gradations. With this guaranty, it is possible to prevent reversal between different levels of tone gradations, when the analog tone gradations and the digital tone gradations are used together. This can prevent tone gradation reversal which tends to occur when the analog tone gradations and the digital tone gradations are used together.

Note that, in the display method of the present embodiment, a final output stage of the source driver circuit 37 shown in FIG. 2 is arranged to be a multiplexer (not shown) which selects one voltage level from eight voltage levels. This arrangement is preferable because the driver circuit consumes less electric power in comparison to the arrangement such as the D/A converting circuit which internally generates the voltage.

As described above, in the display method of the present embodiment, by adding the eight potential selection multiplexer to the source driver circuit 37, the display device can display the increased number of tone gradations, namely 64 tone gradations from the former 16 tone gradations, without increasing the number of the condensers and the TFTs.

Note that, when using the liquid crystal element as the electro-optic element, the organic EL element 42 which is the electro-optic element in FIG. 5 is replaced with the liquid crystal element.

Third Embodiment

Figure 7:
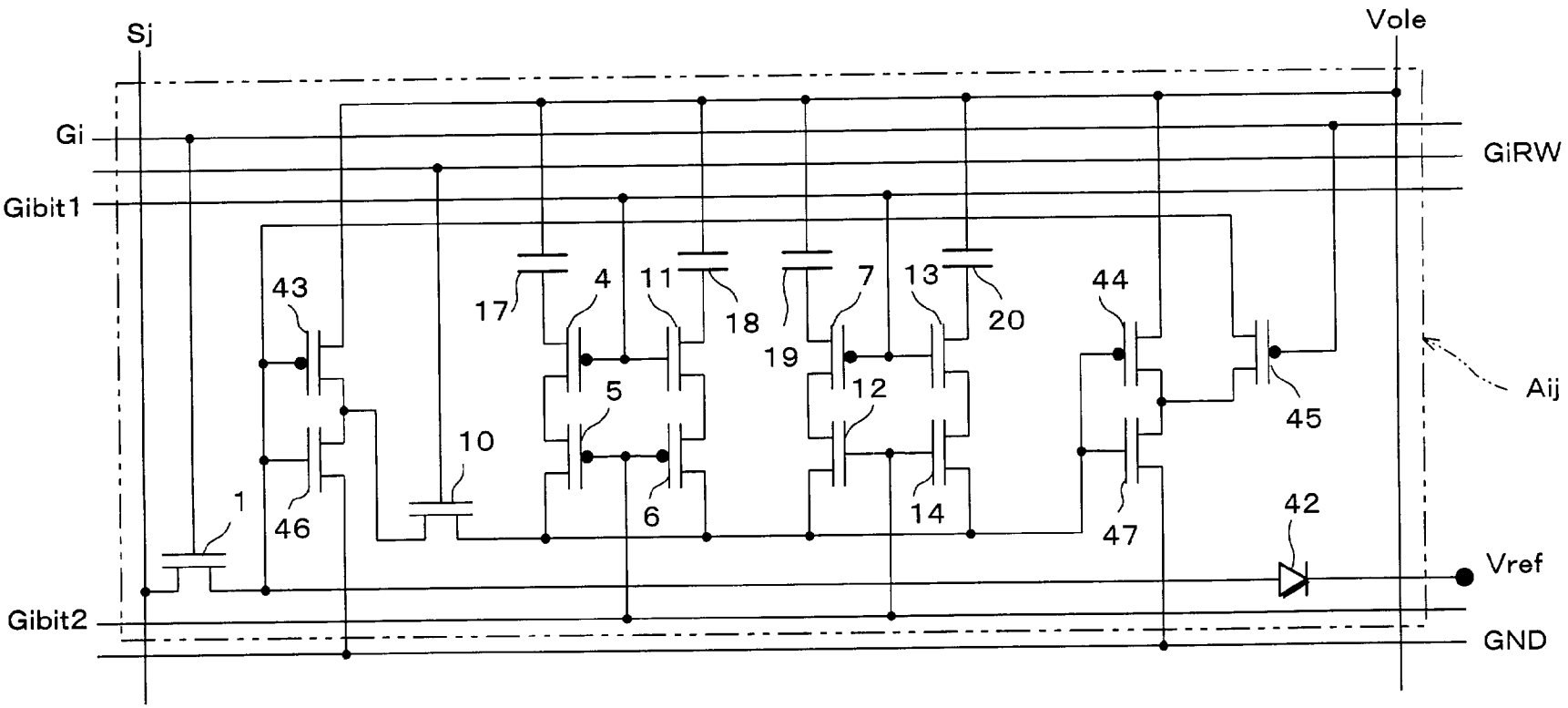
FIG. 7 is a circuit diagram showing an arrangement of a pixel circuit of each pixel section in a display device of a third embodiment of the present invention.
Figure 8:
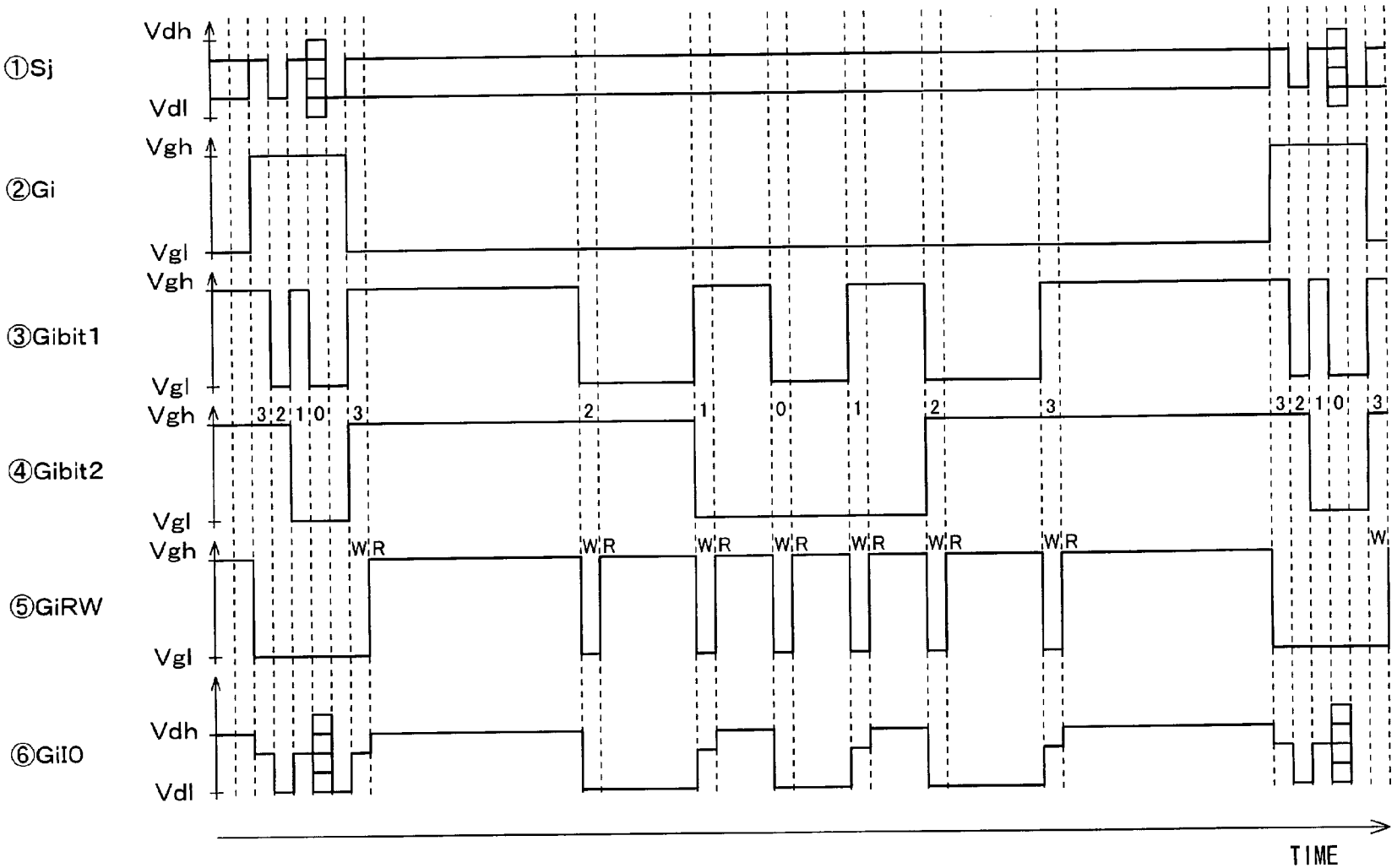
FIG. 8 is a waveform chart of a data line, a gate line and a control line in a display device, which explains operations of an electric circuit in a display method using a display device of a third embodiment.

The following will explain a further embodiment of the present invention with reference to FIGS. 7 and 8. FIG. 7 schematically shows a pixel circuit used in a display method of the present embodiment.

As shown in FIG. 7, in the pixel circuit used in the display method of the present embodiment, a positive pole of the organic EL element 42 is connected to a drain terminal of the n-type TFT 1 which is the first switching element and to a drain terminal of a p-type TFT 45 which is newly adapted in the present embodiment.

Gate terminals of the n-type TFT 1 and the p-type TFT 45 are respectively connected to the gate line Gi. Further, a source terminal of the n-type TFT 1 is connected to the data line Sj. A source terminal of the p-type TFT 45 is connected to an output terminal (a drain terminal) of a first inverter circuit of the buffer circuit composed of the p-type TFT 44 and the n-type TFT 47.

With this arrangement, the n-type TFT 1 is switched ON while the gate line Gi is at the positive selection potential (while ② Gi in FIG. 8 is at the potential Vgh), so as to display the organic EL element 42 with the electric charges supplied from the data line Sj.

Note that, in the arrangement of the pixel circuit shown in FIG. 7, an input terminal of a second inverter circuit composed of a p-type TFT 43 and an n-type TFT 46 is connected to the drain terminal of the n-type TFT 1 which is the second switching element, the drain terminal of the n-type TFT 1 is connected to the positive pole terminal of the organic EL element 42 which is the electro-optic element, and an input terminal of the first inverter circuit is connected with the p-type TFT 45.

Other connecting relations among the input terminal of the first inverter circuit, the output terminal of the second inverter circuit, the n-type TFT 10 which is the third switching element, the condensers 17 through 20, the p-type TFTs 4 through 7, and the n-type TFTs 11 through 14 are the same as those explained with reference to FIG. 1 in the first embodiment, and explanation thereof will be omitted here.

As shown in FIG. 8, in the display method of the present embodiment, for displaying 6-bit tone gradations (=64 tone gradations), binary data of upper 4 bits are recorded to the condensers 17 through 20, and data of lower 2 bits which could not be recorded to these condensers are displayed, while the gate line Gi is at the positive selection potential (while ② Gi in FIG. 8 is at the potential Vgh).

More specifically, during a period when the n-type TFT 1 is selected (the period when ② Gi in FIG. 8 is at the potential Vgh), the potential of the control lines Gibit 2 and Gibit 1 is sequentially varied to be in an order of "3", "2", "1", and "0". Binary data of upper 3 bits are stored in the condensers 20 through 18 during the periods "3" through "1". Then, the potential of the control lines Gibit 2 and Gibit 1 is varied to be "0", so as to store binary data of the fourth upper bit, which is the fourth bit from the uppermost bit, to the condenser 17 during an initial period of the "0". Then, during a period when the n-type TFT 1 is not selected (a period when ② Gi in FIG. 8 is at the potential Vgl), the potential of the control lines Gibit 2 and Gibit 1 is sequentially varied to be in an order of "3", "2", "1", "0", "1", "2", and "3" so as to display tone gradations in the time division manner using the data of upper 4 bits.

As described above, by using the display method of the present embodiment, a structure of the multiplexer, which is required for the final output stage of the source driver 37 (see FIG. 2), can be reduced to four potential levels from the former eight potential levels explained in the second embodiment. This further reduces a circuit area required for arranging the source driver circuit 37.

Note that, for displaying lower four levels of tone gradations among 64 tone gradations while the gate line Gi is at the positive selection potential (while the ② Gi in FIG. 8 is at the potential Vgh), a higher voltage needs to be supplied to the data line Sj in comparison to a case where tone gradations are displayed in the time division manner.

This requires the TFTs, such as the TFT composing the multiplexer at the final output stage of the source driver circuit 37 and the n-type TFT 1 composing the pixel circuit of the pixel, to have higher withstand pressure and larger electric current capacitances in comparison to the TFTs used in the display method explained in the second embodiment. Namely, this requires a large size of the TFTs. For this reason, it is possible to reduce the circuit scales of the source driver circuit 37 and the pixel Aij using the display method of the second embodiment.

Note that, when using the liquid crystal element as the electro-optic element, the organic EL element 42 which is the electro-optic element in FIG. 5 is replaced with the liquid crystal element.

Fourth Embodiment

Figure 9:
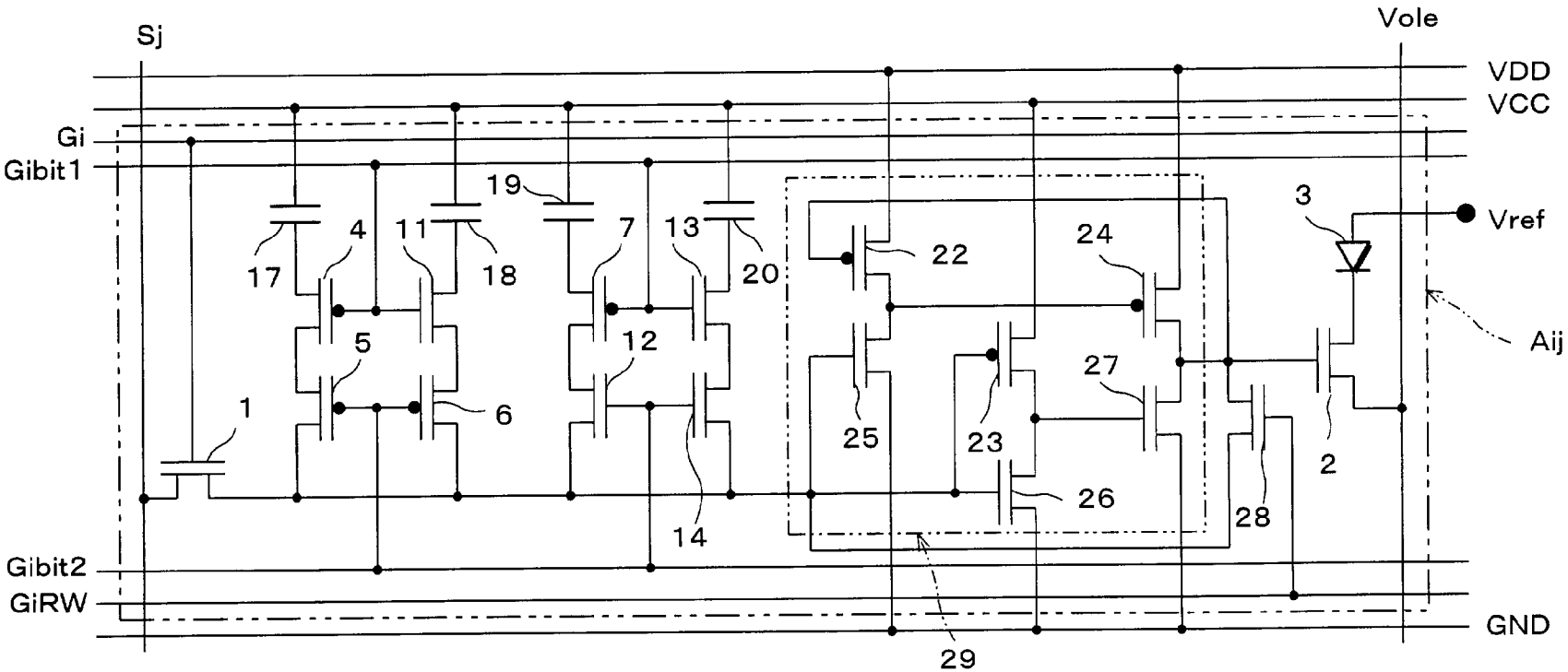
FIG. 9 is a circuit diagram showing an arrangement of a pixel circuit of each pixel section in a display device of a fourth embodiment of the present invention.
Figure 10:
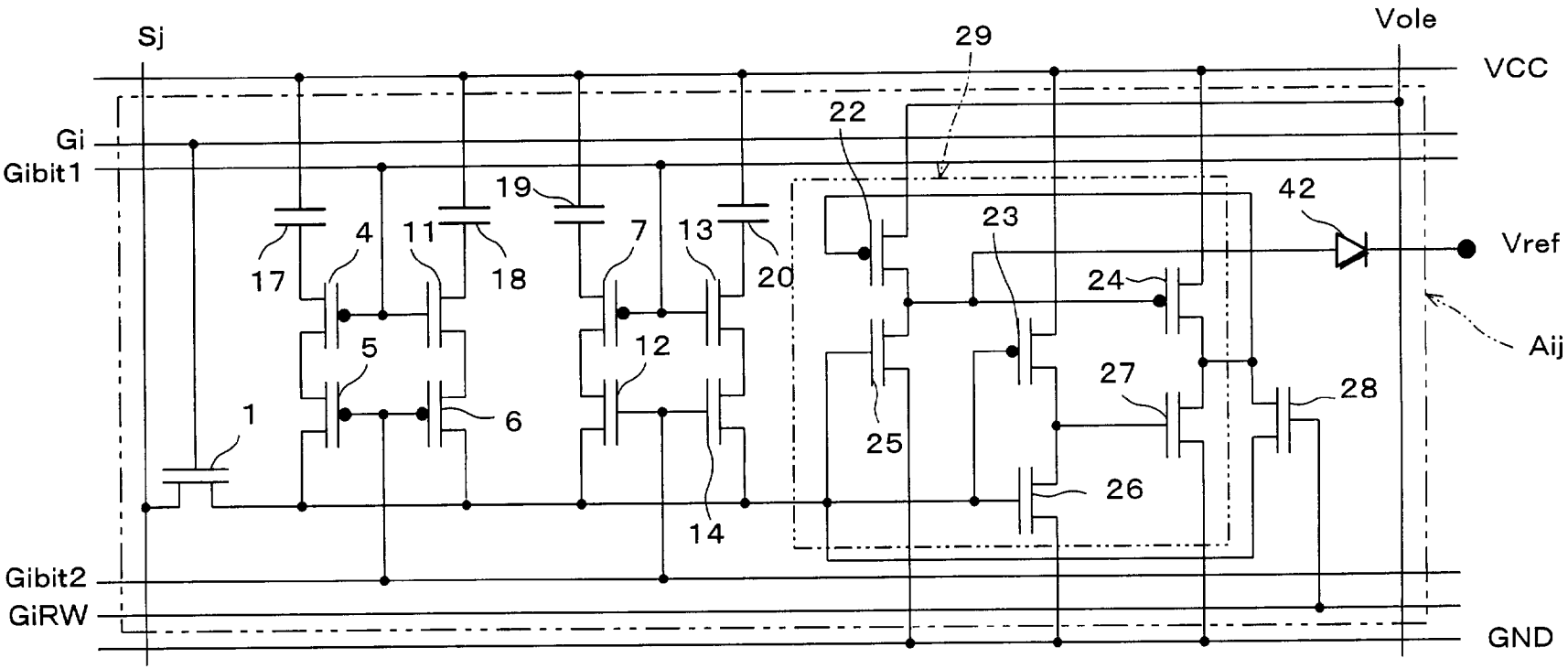
FIG. 10 is a circuit diagram showing an arrangement of a pixel circuit of each pixel section in the display device of the fourth embodiment, which is different from the pixel circuit in FIG. 9.

The following will explain yet another embodiment of the present invention with reference to FIGS. 9 and 10. FIG. 9 schematically shows a pixel circuit used in a display method of the present embodiment.

The pixel circuit of the present embodiment is provided with a voltage amplifier circuit (an amplifier circuit, a buffer circuit) 29 instead of the buffer circuit 21 in the pixel circuit of the first embodiment. An output terminal of the voltage amplifier circuit 29 is connected to the electro-optic element composed of the n-type TFT 2 and the organic EL element 3.

More specifically, as shown in FIG. 9, the drain terminal of the n-type TFT 1 which is the second switching element is connected to the condensers 17 through 20 via the p-type TFTs 4 through 7 and the n-type TFTs 11 through 14 which are the first switching elements. Further, the drain terminal of the n-type TFT 1 is connected to gate terminals of n-type TFTs 25 and 26 and of a p-type TFT 23 which compose the voltage amplifier circuit 29.

The voltage amplifier circuit 29 is arranged so as to include first through third inverter circuits, namely three inverter circuits. The first inverter circuit is composed of the p-type TFT 23 and the n-type TFT 26, and an output terminal of the first inverter circuit is connected to a gate terminal of an n-type TFT 27 composing the second inverter circuit. The second inverter circuit is composed of the n-type TFT 27 and a p-type TFT 24. Further, the third inverter circuit is composed of the n-type TFT 25 and a p-type TFT 22.

Then, an output terminal of the second inverter circuit is connected to a gate terminal of the p-type TFT 22 composing the third inverter circuit, whereas an output terminal of the third inverter circuit is connected to a gate terminal of the p-type TFT 24 composing the second inverter circuit.

By arranging the pixel circuit as described above, when the potential stored in the condensers 17 through 20 and a power supply voltage VCC connected to a source terminal of the p-type TFT 23 have an amplitude of 5V, a voltage having an amplitude of power supply voltage VDD can be obtained as output voltages of the second inverter circuit and of the third inverter circuit, where the power supply voltage VDD connected to source terminals of the p-type TFTs 22 and 24 is not less than 5 V.

The above-described operations of the voltage amplifier circuit 29 will be explained below. When the potential VCC is applied to the gate terminal of the n-type TFT 27 of the second inverter circuit composing the voltage amplifier circuit 29, the n-type TFT 27 is switched ON so as to apply a voltage orienting to a GND potential to the gate terminal of the p-type TFT 22 composing the third inverter circuit. In contrast to the gate terminal of the n-type TFT 27, the gate terminal of the n-type TFT 25 of the third inverter circuit is applied with the GND potential. As a result, VDD is obtained as a potential of the output terminal of the third inverter circuit, whereas the GND potential is obtained as a potential outputted from the second inverter circuit.

Further, when the potential VCC is applied to the gate terminal of the n-type TFT 25 of the third inverter circuit, the n-type TFT 25 is switched ON so that the output terminal of the third inverter circuit is oriented to the GND potential. Thus, the voltage orienting to the GND potential is applied to the gate terminal of the p-type TFT 24 composing the second inverter circuit. In contrast to the gate terminal of the n-type TFT 25, the gate terminal of the n-type TFT 27 is applied with the GND potential. As a result, VDD is obtained as a potential of the output terminal of the second inverter circuit.

Then, the output of the voltage amplifier circuit 29 is returned to an input terminal of the voltage amplifier circuit 29 via source and drain terminals of an n-type TFT 28 (the third switching element). At this point, by setting the potential of the gate terminal, at which the n-type TFT 28 is switched ON, at approximately (VCC+2) V, the voltage amplitude which returns to the input terminal of the voltage amplifier circuit 29 can be limited at approximately VCC.

This is because the potential higher than the gate terminal voltage of the n-type TFT 28 is not transmitted to the drain terminal even when the voltage VDD is applied to the source terminal of the n-type TFT 28. In view of the differences of approximately 1 V through 3 V in a threshold voltage of the n-type TFT 28, by setting the gate terminal potential of the n-type TFT 28 at approximately (VCC+2) V, the voltage of approximately (VCC−1) V to (VCC+1) V is returned to the drain terminal.

This enables the buffer circuit 21 explained in the first embodiment to be replaced with the voltage amplifier circuit 29. Note that, the voltage amplifier circuit 29 is composed of the two inverter circuits of the first inverter circuit and the second inverter circuit, and thus can be regarded as a kind of the buffer circuit.

The voltage that is returned to the input terminal of the voltage amplifier circuit 29 can recharge the potential of the input terminal of the voltage amplifier circuit 29 and the potential of the respective condensers which is ON. Thus, also in the present embodiment, the static memory can be arranged using the condensers.

As described above, by adopting the pixel circuit provided with the voltage amplifier circuit 29 capable of power supply amplification, the voltage amplitude of the buffer circuit on an input terminal side can be limited to be smaller than the voltage amplitude for driving the electro-optic element. Thus, the withstand pressure of the TFTs composing the circuit can be designed smaller, thereby reducing the area required for the circuit. Further, it is possible to limit the voltage amplitude of the data which are transferred from the source driver circuit to the pixel Aij via the data line Sj, thereby reducing electric power consumption.

Note that, the pixel circuit of the present embodiment is so arranged that the output terminal of the second inverter circuit composing the voltage amplifier circuit 29 is connected to the n-type TFT 2 composing the electro-optic element and to the n-type TFT 28 which is the third switching element, as shown in FIG. 9. However, the pixel circuit of the present embodiment may be so arranged that the organic EL element 42 as the electro-optic element is connected to the output terminal of the third inverter circuit, as shown in FIG. 10. Further, the electric current outputted from the third inverter circuit may directly drive the organic EL element 42 by composing the electro-optic element only with the organic EL element 42.

Fifth Embodiment

Figure 11:
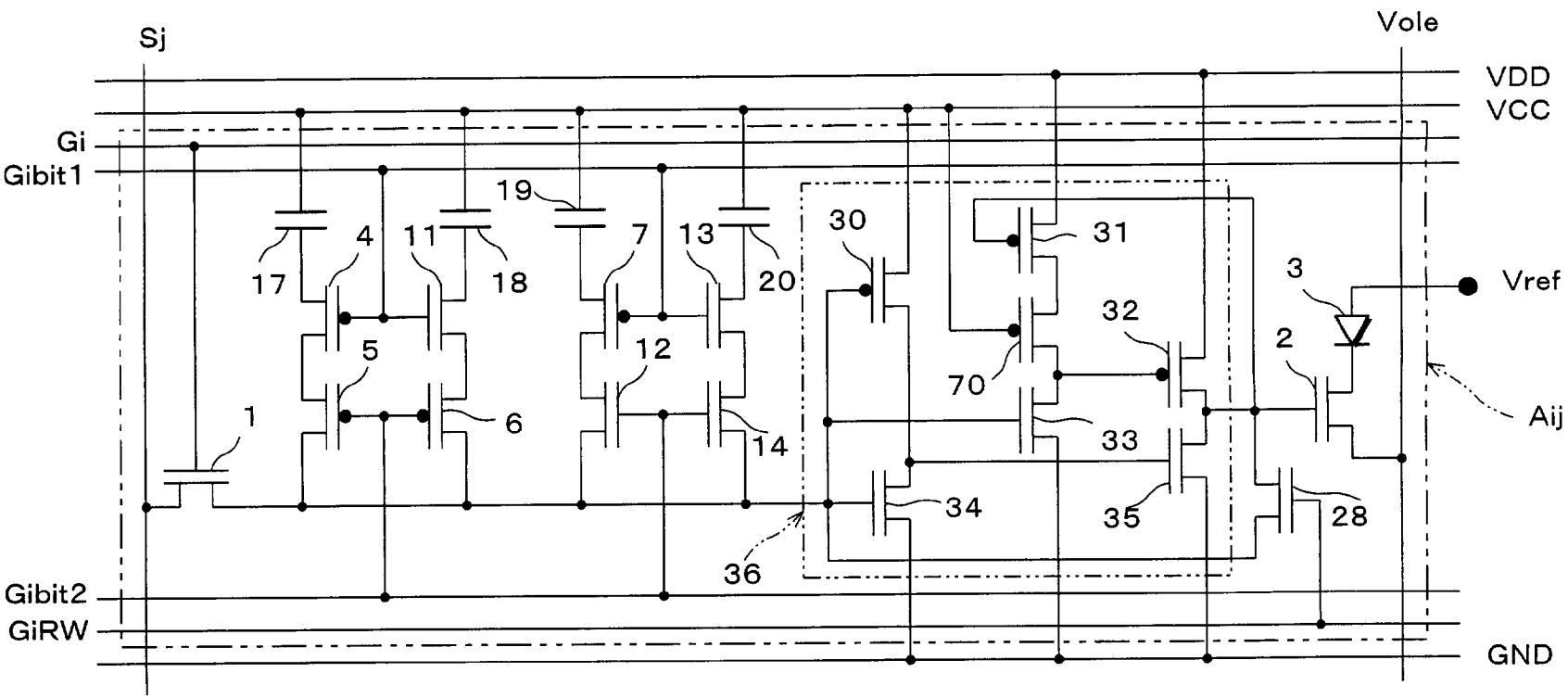
FIG. 11 is a circuit diagram showing an arrangement of a pixel circuit of each pixel section in a display device of a fifth embodiment of the present invention.

The following will explain still further embodiment of the present invention with reference to FIG. 11. FIG. 11 schematically shows a pixel circuit used in a display method of the present embodiment.

In the voltage amplifier circuit 29 (see FIGS. 9 and 10) composing the pixel circuit of the fourth embodiment, the potential of the condensers 17 through 20, which are the potential holding means, is applied to the n-type TFT 25 of the third inverter circuit in the voltage amplifier circuit 29. In this case, when a voltage amplitude, which is applied from the condensers 17 through 20 to the gate terminal of the n-type TFT 25, is smaller than the power supply voltage VDD, the voltage amplifier circuit 29 may not operate normally. Then, because the potential of the condensers 17 through 20 is attenuated, the gate terminal of the n-type TFT 25 of the voltage amplifier circuit 29 may be applied with a potential smaller than the power supply voltage VDD.

For this reason, it is preferable to provide another inverter circuit before the gate terminal of the n-type TFT 25 of the voltage amplifier circuit 29 composing the pixel circuit of the fourth embodiment. In this case, it is preferable to compose the voltage amplifier circuit 36 with a smaller number of the TFTs as shown in FIG. 11, because an increased number of TFTs are required for composing the pixel when the above-mentioned another inverter circuit is provided.

FIG. 11 shows an arrangement of the pixel circuit of each pixel in the display device of the present embodiment. As shown in FIG. 11, as input terminals of the voltage amplifier circuit (the amplifier circuit, the buffer circuit) 36, the pixel circuit is provided with (a) a gate terminal of a p-type TFT 30 composing the third inverter circuit which includes the p-type TFT 30 and the n-type TFT 34, (b) a gate terminal of a p-type TFT 70, and (c) a gate terminal of an n-type TFT 33 composing the first inverter circuit which includes the n-type TFT 33, the p-type TFT 70, and a p-type TFT 31. A source terminal of the p-type TFT 30 composing the third inverter circuit is connected to the power supply voltage line VCC, whereas a drain terminal of the p-type TFT 30 is connected to a source terminal of the n-type TFT 34. A drain terminal of the n-type TFT 34 is connected to the GND line. With this arrangement, the output of the third inverter circuit has an amplitude between the power supply voltage VCC and GND.

Further, the n-type TFT 33 of the first inverter circuit is connected in series with the p-type TFT 70 and the p-type TFT 31 (via source and drain terminals). A gate terminal of the p-type TFT 70 is connected to the power supply line VCC on a lower voltage side, whereas a source terminal of the p-type TFT 31 is connected to the power supply line VDD on a higher voltage side. Further, a gate terminal of the p-type TFT 31 is connected to an output terminal of the second inverter circuit, whereas a drain terminal of the p-type TFT 31 is connected to the GND line.

With this arrangement, a gate terminal of the p-type TFT 32 composing the second inverter circuit is applied with the potential which has been limited at a gate terminal voltage of the p-type TFT 70.

In the second inverter circuit, the p-type TFT 32 is connected in series with the n-type TFT 35 (via source and drain terminals). A source terminal of the p-type TFT 32 is connected to the power supply line VDD on the higher voltage side, whereas a gate terminal of the p-type TFT 32 is connected to an output terminal of the first inverter circuit. Further, a gate terminal of the n-type TFT 35 is connected to an output terminal of the third inverter circuit, whereas a drain terminal of the n-type TFT 35 is connected to the GND line.

With this arrangement, a gate terminal of the n-type TFT 35 composing the second inverter circuit is applied with the output (VCC/GND) from the third inverter circuit.

As a result, the voltage amplifier circuit 36 in FIG. 11 has an enhanced power for the voltage amplification, so as to generate the voltage having a larger value than the voltage amplifier circuit 29 in FIG. 9.

Operations of the voltage amplifier circuit 36 are explained as follows. When the input terminal of the voltage amplifier circuit is at a potential near the GND potential, the potential VCC is obtained as the output of the third inverter circuit. Further, the n-type TFT 33 composing the first inverter circuit is switched OFF.

As a result, the potential VCC is applied to the gate terminal of the n-type TFT 35 composing the second inverter circuit, whereas a potential higher than the GND potential is applied to the gate terminal of the p-type TFT 32. This relatively lowers an ON resistance of the n-type TFT 35 than an ON resistance of the p-type TFT 32, so that the output of the second inverter circuit is oriented to the GND potential.

Then, the potential is applied to the gate terminal of the p-type TFT 31 composing the first inverter circuit. This switches ON the p-type TFT 31 so that the output of the second inverter circuit is oriented to the potential VDD. As a result, the potential of the voltage amplifier circuit 36 is stabilized at the GND potential.

Further, when the input terminal of the voltage amplifier circuit 36 is at a potential near the VCC potential, the GND potential is obtained as the output of the third inverter circuit. Further, the n-type TFT 33 composing the first inverter circuit is switched ON. Even when the p-type TFT 31 is ON, the output potential of the first inverter circuit is oriented to the GND potential, because of the intervening p-type TFT 70 which has the gate voltage limited at the potential VCC.

As a result, the gate terminal of the n-type TFT 35 composing the second inverter circuit is applied with the GND potential so as to switch OFF the n-type TFT 35. Further, the gate terminal of the p-type TFT 32 is applied with a potential near the GND potential so as to switch ON the p-type TFT 32. As a result, the output of the second inverter circuit is oriented to the potential VDD.

Then, the potential is applied to the gate terminal of the p-type TFT 31 composing the first inverter circuit so as to switch OFF the p-type TFT 31. This stabilizes the output of the second inverter circuit at the GND potential. As a result, the output of the voltage amplifier circuit 36 is stabilized at the potential VDD.

Note that, in the pixel circuit shown in FIG. 11, the output from the voltage amplifier circuit 36 is returned to an input terminal of the third inverter circuit composing the p-type TFT 30 and the n-type TFT 34 via the n-type TFT 28.

Namely, the pixel circuit of the present embodiment is so arranged that the output of the voltage amplifier circuit 36 which also functions as the buffer circuit is returned to output terminals of the condensers 17 through 20 which are the potential holding means, as the voltage having the positive polarity.

Sixth Embodiment

Figure 12:
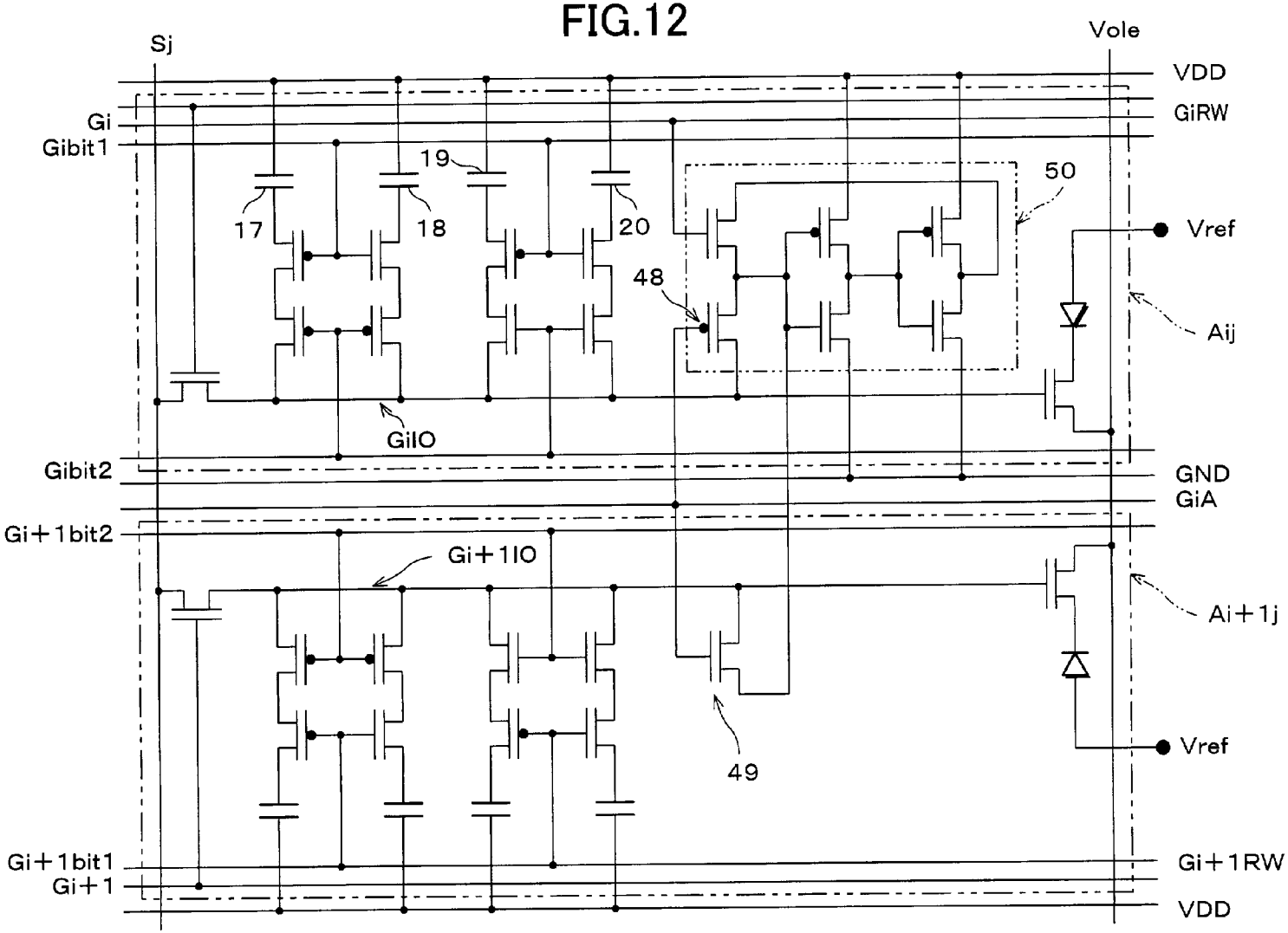
FIG. 12 is a circuit diagram showing an arrangement of a pixel circuit of each pixel section in a display device of a sixth embodiment of the present invention.
Figure 13:
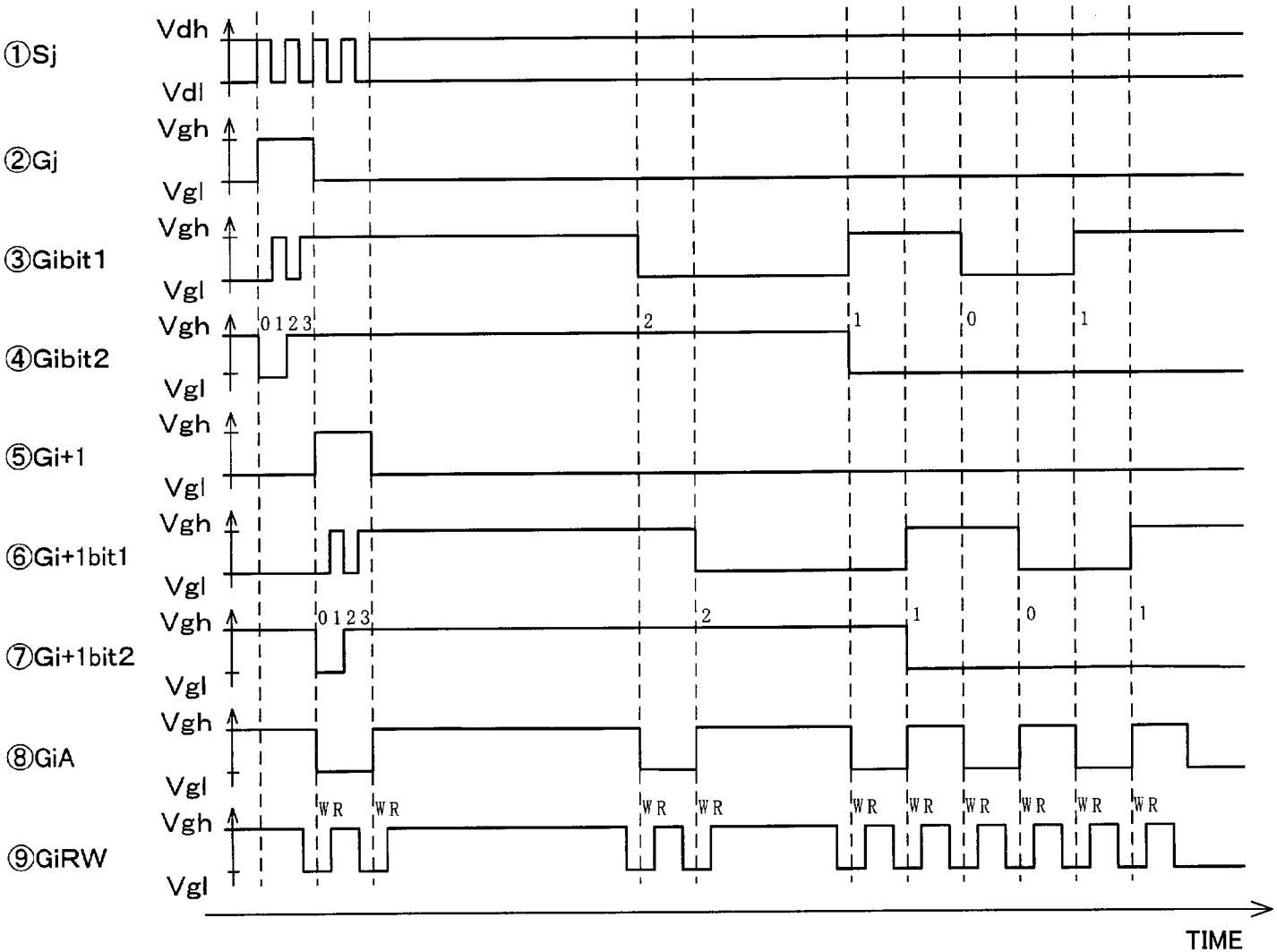
FIG. 13 is a waveform chart of a data line, a gate line and a control line in a display device, which explains operations of an electric circuit in a display method using a display device of the sixth embodiment.
Figure 14:
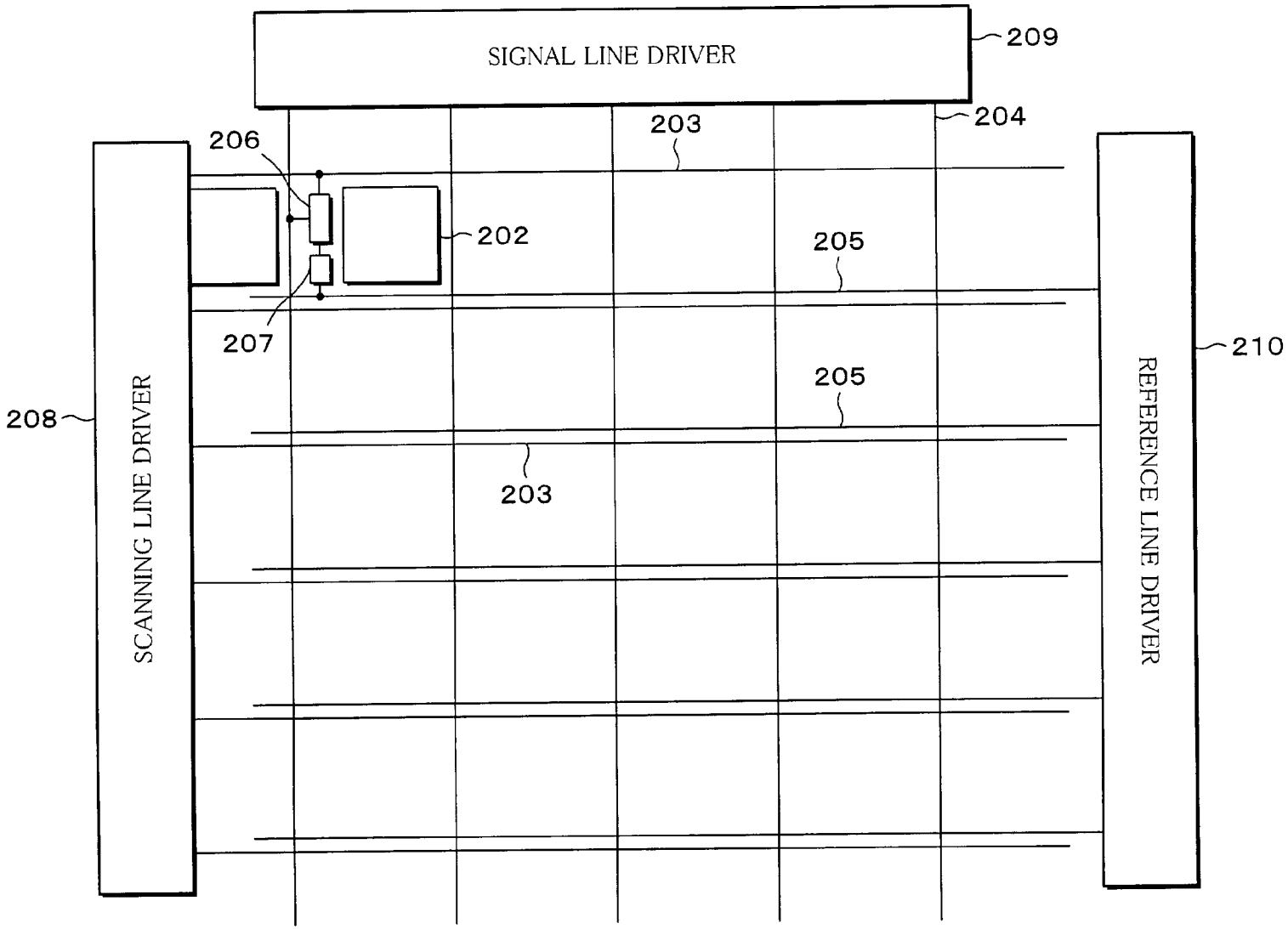
FIG. 14 is a block diagram schematically showing an arrangement of a conventional display device.
Figure 15:
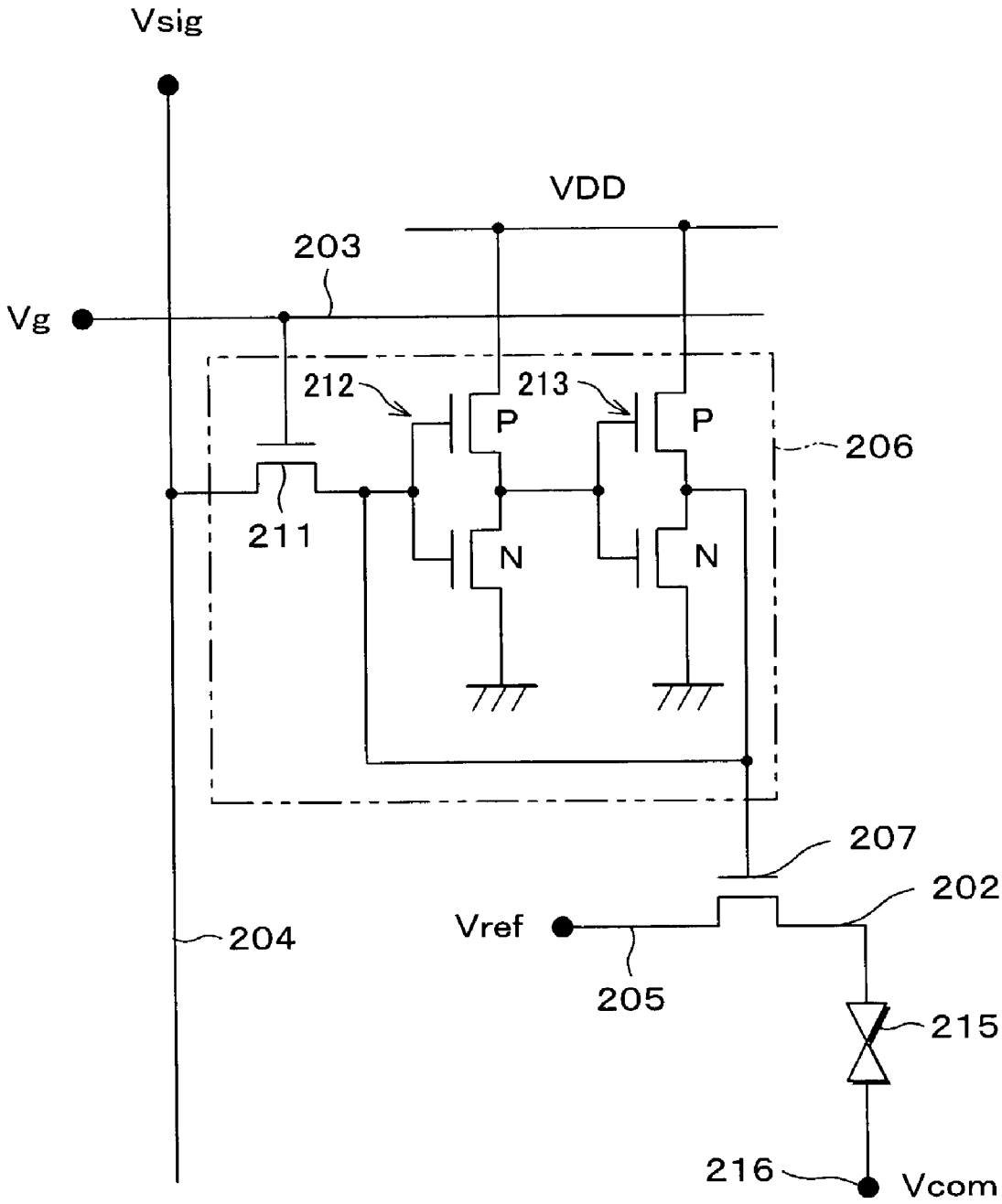
FIG. 15 is a circuit diagram showing a detailed arrangement of each pixel section in the display device of FIG. 14.
Figure 16:
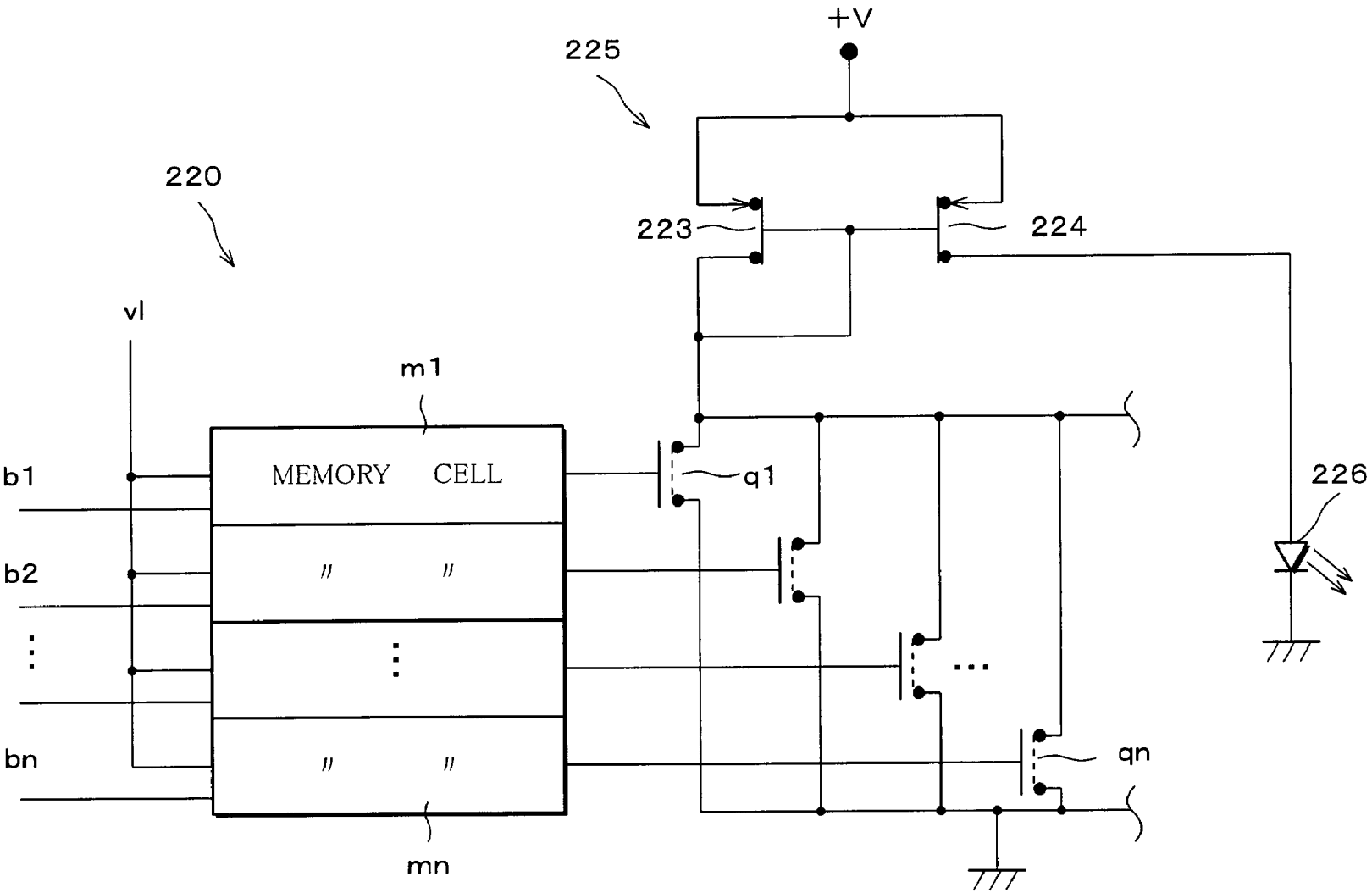
FIG. 16 is a diagram showing an arrangement of each pixel section in another conventional display device.
Figure 17:
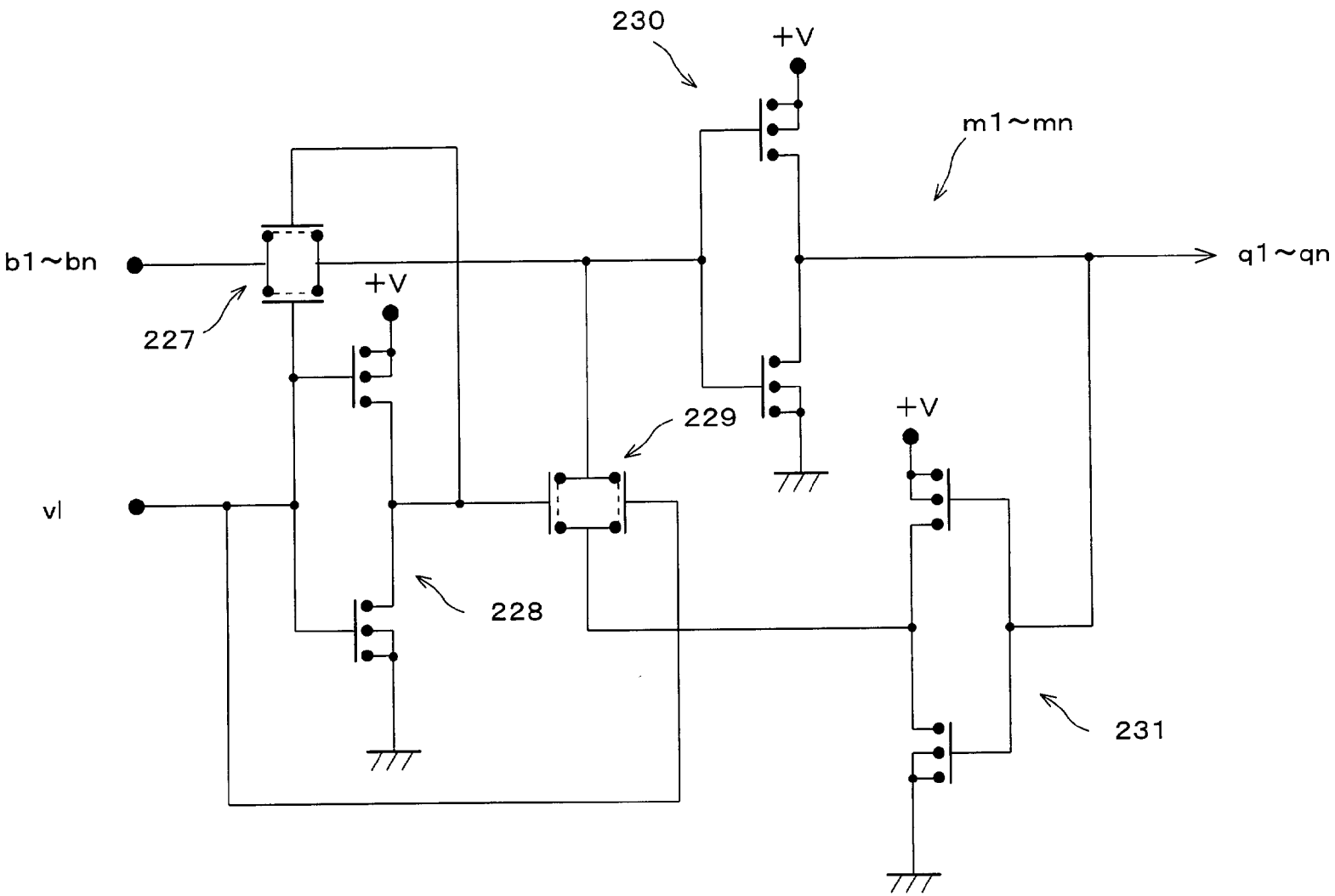
FIG. 17 is a circuit diagram showing a detailed arrangement of a memory cell in the display device of FIG. 16.
Figure 18A:
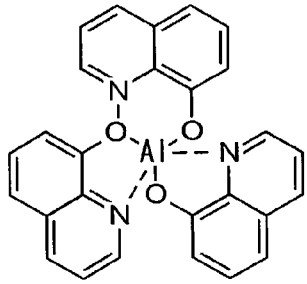
FIGS. 18(*a*) through (*e*) are explanatory diagrams explaining structures of compounds composing an organic multilayer film of the display device in accordance with the first embodiment.
Figure 18B:
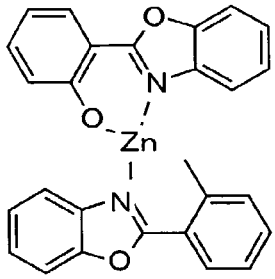
Figure 18C:
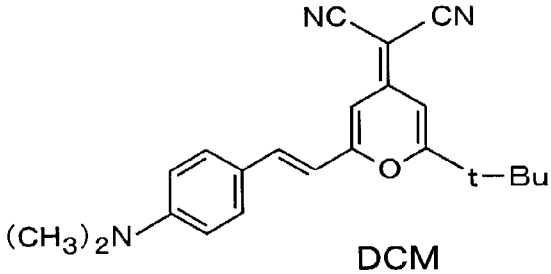
Figure 18D:
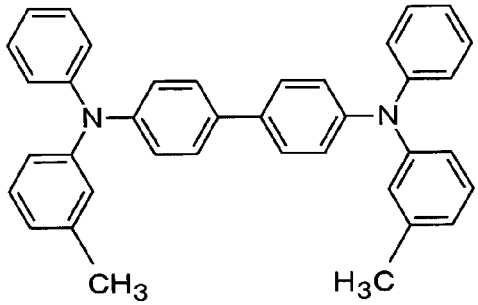
Figure 18E:
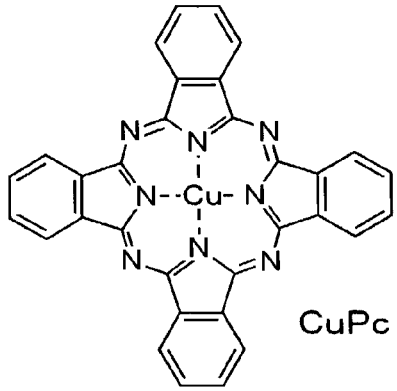

The following will explain an additional embodiment of the present invention, where a plurality of pixels correspond to one buffer circuit, with reference to FIGS. 12 and 13. FIG. 12 schematically shows a pixel circuit used in a display method of the present embodiment.

The pixel circuit of the display device of the present embodiment basically has the same arrangement as the pixel circuit explained using FIG. 1 in the first embodiment, but differs from it in that one buffer circuit corresponds to two pixels Aij and Ai+1j. As shown in FIG. 12, lines GiIO and Gi+1IO and an input terminal of a buffer circuit 50, which indirectly connect potential holding means of the two pixels Aij and Ai+1j, are connected via a p-type TFT 48 and an n-type TFT 49. Gate terminals of the p-type TFT 48 and the n-type TFT 49 are commonly connected to a control line GiA. Thus, the n-type TFT 49 is switched ON while the control line GiA is at the positive selection potential: Vgh, whereas the p-type TFT 48 is switched ON while the control line GiA is at the negative selection potential: Vgl.

More specifically, as shown in FIG. 13, during a period when the pixel Aij is selected (a period when ② Gi in FIG. 13 is at the potential Vgh), the control line GiA is set at the positive selection potential: Vgh (⑧ GiA in FIG. 13) so as to connect the buffer circuit 50 to Gi+1jIO on the pixel Ai+1j side. Thus, the 4-bit tone gradation data, which are to be displayed by the pixel Aij, are transferred to the data line (① Sj in FIG. 13).

Then, where the potential of the control lines Gibit 2 and Gibit 1 is expressed in the form of (the potential of (④ Gibit 2, the potential of (③ Gibit 1), the combination is sequentially varied during the selection period to be (negative selection potential: Vgl, negative selection potential: Vgl (hereinafter referred to as "0")), (negative selection potential: Vgl, positive selection potential: Vgh (hereinafter referred to as "1")), (positive selection potential: Vgh, negative selection potential: Vgl (hereinafter referred to as "2")), and (positive selection potential: Vgh, positive selection potential: Vgh (hereinafter referred to as "3")). This allows the 4-bit tone gradation data, which were transferred to the data line (① Sj in FIG. 13) to be displayed by the pixel Aij, to be stored in the respective condensers 17 through 20 during the respective periods corresponding to "0", "1", "2" and "3".

Next, during a period when the pixel Ai+1j is selected (a period when ⑤ Gi+1 in FIG. 13 is at the potential Vgh), the control line GiA is set at the negative selection potential: Vgl (⑧ GiA in FIG. 13) so as to connect the buffer circuit 50 to the line GiIO on the pixel Aij side. Thus, the 4-bit tone gradation data, which are to be displayed by the pixel Aij, are transferred to the data line (① Sj in FIG. 13). Then, the potential of control lines Gi+1 bit 2 and Gi+1 bit 1 (⑦ (and (⑥ in FIG. 13) is sequentially varied during the selection period to be in an order of "0", "1", "2" and "3". This allows the 4-bit tone gradation data, which were transferred to the data line (① Sj in FIG. 13) to be displayed by the pixel Ai+1j, to be stored in the respective condensers 17 through 20 during the respective periods corresponding to "0", "1", "2" and "3".

Further, during this period, namely the period when the pixel Ai+1j is selected, the control line GiRW is set at the non-selection potential: Vgl (⑨ GiA in FIG. 13) and the potential of the control lines Gibit 2 and Gibit 1 is set at "3" so as to send the potential stored in the condenser 20 (see FIG. 12) to the buffer circuit 50. Following this, the control line GiRW is set at the selection potential: Vgh so as to recharge the condenser 20 with the output potential of the buffer circuit 50 and to allow the electro-optic element to perform display operations in accordance with the binary potential stored in the condenser 20.

Next, during a period when the pixels Aij and Ai+1j are not selected (a period when ② Gi and ⑤ Gi+1 in FIG. 13 are both at the potential Vgh), the control line GiA is set at the positive selection potential: Vgh (⑧ GiA in FIG. 13) so as to connect the buffer circuit 50 to the line Gi+1jIO on the pixel Ai+1j side. During the period, the potential of Gi+1 bit 2 and Gi+1 bit 1 (⑦ and ⑥ in FIG. 13) is set at "3" so as to recharge the potential stored in the condenser 20 to the condenser 20 as an output potential of the buffer circuit 50 and to allow the electro-optic element to perform display operations in accordance with the binary potential stored in the condenser 20.

Hereinafter, the same operations are carried out as in the case of "3" as described above, during the respective periods when the potential of the control lines Gibit 2, Gibit 1, Gi+1 bit 2, and Gi+1 bit 1 are varied to be "2", "1", "0", etc.

As described above, by providing the TFT between the buffer circuit and the line GiIO of each pixel so as to allocate one buffer circuit corresponding to the plurality of pixel circuits, an increased number of memory elements can be arranged in each pixel.

Therefore, in comparison to the arrangement of the pixel circuit of FIG. 1 explained in the first embodiment, the arrangement of the pixel circuit of the present embodiment as shown in FIG. 12 enables a smaller pixel to display the same number of tone gradations, or enables the same size of pixel to display an increased number of tone gradations, thus proving to be highly effective.

The display device of the present invention may be arranged so as to include (a) electro-optic elements arranged in a matrix, each of the electro-optic elements being arranged in a vicinity of an intersection of a first line and a second line, (b) potential holding means corresponding to each of the electro-optic elements, (c) a buffer circuit, which is supplied with a potential of the potential holding means for outputting the potential having a positive polarity to the potential holding means, (d) first switching elements corresponding to each of the potential holding means, provided between the electro-optic element and each of the potential holding means, when the electro-optic element corresponds to the plurality of potential holding means, (e) a second switching element provided between the potential holding means and the first line, which is switched ON and OFF by the second line, wherein an output terminal of the buffer circuit and an output terminal of the potential holding means are connected directly or indirectly via a third switching element.

The display device may be arranged so as to control a display state of the electro-optic element in response to the potential holding means or the buffer circuit by (1) setting the potential of the potential holding means corresponding to a potential of the first line, while the second switching element is ON, and (2) applying the potential of the potential holding means to an input terminal of the buffer circuit so as to recharge the potential holding means with the output voltage of the buffer circuit which is set by the applied voltage of the buffer circuit, while the second switching element is OFF.

Further, the foregoing display device may be arranged so as to control the display state of the electro-optic element, when the plurality of potential holding means are provided, by (1) selecting one potential holding means among the plurality of the potential holding means by means of the first switching element, while the second switching element is OFF, (2) applying the potential of the selected potential holding means to the input terminal of the buffer circuit so as to recharge the selected potential holding means with the output voltage of the buffer circuit set by the applied voltage of the buffer circuit, and (3) alternately switching the potential holding means to supply the potential to the buffer circuit by means of the first switching element.

When the third switching element is provided between the output terminal and the input terminal of the buffer circuit, the display device may be so arranged that (a) the first switching element switches the potential holding means to supply the potential to the buffer circuit, while the third switching element is OFF, and (b) the third switching element is switched ON when the potential of the output terminal of the buffer circuit is set by the potential of the input terminal of the buffer circuit.

The display device may be arranged so as to (1) set the potential of the potential holding means to a binary value, and set a display state of the electro-optic element to a value among more than two values while the second switching element is ON, and (2) reset the display state of the electro-optic element to a state corresponding to the binary potential set in the potential holding means, while the second switching element is OFF.

The display device may be so arranged that the voltage applied to the electro-optic element corresponding to the input voltage of the buffer circuit has a larger amplitude than the input voltage of the buffer circuit.

As described above, it is preferable that the display device of the present invention is so arranged that a third switching element is provided between an input terminal and the output terminal of the buffer circuit.

With this arrangement, the third switching element provided between the input terminal and the output terminal of the buffer circuit can prevent the output potential of the buffer circuit from affecting the input potential of the buffer circuit.

Generally, in order to increase the capacitance of the potential holding means, a large area corresponding to the capacitance needs to be assigned to the potential holding means. In this case, however, the third switching element is provided so as to eliminate the need of assigning the large area to the potential holding means. This reduces the size of the potential holding means, thereby enabling the display device to be made smaller.

The display device of the present invention is characterized by being so arranged that the first switching element switches the plurality of potential holding means while the third switching element is OFF, the buffer circuit sets a potential of the output terminal of the buffer circuit in accordance with a potential of the input terminal of the buffer circuit while the third switching element is OFF, and the third switching element is switched ON when the potential of the output terminal of the buffer circuit is set.

With this arrangement, by switching the first switching elements to be ON while the third switching element is OFF, it is possible to switch the potential holding means to supply the potential to the buffer circuit. Further, after the output having the positive polarity corresponding to the potential of the potential holding means is obtained from the buffer circuit, it is possible to recharge the potential of the potential holding means, while the third switching element is switched ON.

Note that, the potential holding means may correspond to the plurality of first switching elements, or may correspond to one first switching element. It is preferable that the potential holding means corresponds to the plurality of first switching elements, because the number of required control lines for the first switching elements can be reduced per pixel.

On the other hand, it is also preferable that the potential holding means corresponds to one first switching element, because the first switching elements corresponding to the respective potential holding means can be independently controlled so as to control any two potential holding means not to be simultaneously selected.

Therefore, the dynamic type memory element can be used as the pseudo static type memory element, with preventing the output potential of the buffer circuit from affecting the input potential of the buffer circuit. This reduces the number of the TFTs per 1 bit of memory element.

It is preferable that the display device of the present invention is so arranged that the buffer circuit amplifies an amplitude of an input voltage, and an amplitude of a gate voltage of the third switching element is smaller than an amplitude of an output voltage of the buffer circuit.

With this arrangement, the buffer circuit can amplify the amplitude of the input voltage supplied from the potential holding means so as to output the amplified voltage to the electro-optic element. In other words, the buffer circuit can amplify the amplitude of the voltage supplied from the potential holding means so as to output the voltage having the amplitude required for the electro-optic element.

Here, when the voltage amplified by the buffer circuit is directly returned to the input terminal of the buffer circuit, the voltage may have a higher amplitude than the voltage expected at the input terminal. This may cause a defect in the first and second switching elements. However, the amplitude of the voltage which can pass through the third switching element is limited at the gate voltage of the third switching element. Thus, by arranging the amplitude of the gate voltage of the third switching element to be smaller than the amplitude of the output voltage of the buffer circuit, the faulty operation can be prevented.

Generally, in order to reduce the size of the switching elements such as the TFT, the withstand pressure needs to be set low. Further, by limiting the gate voltage for driving the switching elements to be low, less electric power is consumed for charging up and down the gate electrode. Therefore, in order to reduce the electric power consumed by the display device, the input terminal side of the buffer circuit (including the first switching elements) is preferably arranged to be a low voltage circuit. For this purpose, the amplitude of the voltage which returns to the input terminal of the buffer circuit is preferably limited.

Therefore, the amplitude of the gate voltage of the third switching element provided between the output terminal of the buffer circuit and the output terminal of the potential holding means is set to be smaller than the amplitude of the output voltage of the buffer circuit.

With this arrangement, it is possible to limit the amplitude of the voltage supplied to the gate terminal of the third switching element provided between the input terminal and the output terminal of the buffer circuit, so as to allow the voltage to return from the output terminal to the input terminal of the buffer circuit within the range of the limited amplitude of the voltage. For example, in a case where the n-type TFT is used as the third switching element, when 12 V of voltage is applied to the source terminal of the n-type TFT, approximately 5 V of the voltage is obtained from the drain terminal of the n-type TFT, while applying 6 V of voltage to the gate terminal.

As explained above, by providing the third switching element and limiting the amplitude of the gate voltage of the third switching element, the withstand pressure of the TFT on the input terminal side of the buffer circuit can be set low, thus reducing the size of the TFT. Further, the potential of the lines for controlling the TFTs can be reduced, thereby reducing the electric power consumed by the display device.

It is preferable that the display device of the present invention is so arranged that capacitive coupling means is provided at the intersection of the first line and the second line, so as to couple capacitances between power supply lines of the buffer circuit.

With this arrangement, the capacitive coupling means can supply the power supply lines of the buffer circuit with necessary electric charges for switching. This can prevent noise or faulty operation of the display device due to a switching defect.

For example, between the power supply lines of the buffer circuit of the display device of the present invention, a line which is wider than the required line is provided so as to form the capacitive coupling means such as the condenser. By providing the condenser in the pixel as described above, the electric charges, which are required when the output states of the buffer circuit and of the inverter circuit vary, can be supplied from the condenser provided in the pixel, thus reducing the electric charges to be supplied from the power supply lines.

This reduces noise which generates when the electric charges supplied to the power supply lines vary, thereby preventing faulty operation of the buffer circuit and of the inverter circuit. Further, this reduces variation in the potential applied to the electro-optic element, thereby reducing deterioration in the display quality. As a result, it is possible to improve the reliability and the display quality of the image display device.

It is preferable that the display method of the present invention is arranged so as to include the steps of (d) selecting one potential holding means among the plurality of potential holding means by means of the first switching element while the second switching element is OFF, applying the potential of the selected potential holding means to the input terminal of the buffer circuit, and (e) controlling the display state of the electro-optic element in such a manner that the first switching element switches the potential holding means to supply the potential to the buffer circuit.

With the method, tone gradations can be displayed by switching the display states of the electro-optic element in the time division manner.

More specifically, a plurality of potential holding means such as condensers are provided in each pixel, and the first switching elements are respectively arranged between each of the potential holding means and the input terminal of the buffer circuit, corresponding to each of the potential holding means. In the step (d), by switching ON one of the first switching elements, one potential holding means can be selected among the plurality of potential holding means, and the potential of the selected potential holding means can be applied to the input terminal of the buffer circuit.

Then, in the step (e), the first switching elements are alternatively switched ON so that the buffer circuit recharges the potential holding means. Accordingly, the potential can be supplied to the electro-optic element so as to allow the display device to display tone gradations in the time division manner.

A method of the time division display is explained below, referring respective periods when the respective first switching elements are switched ON to as a first period, a second period, . . . , respectively. During the first period, a particular switching element (hereinafter referred to as a switching element A) is switched ON among the plurality of first switching elements, and a potential of the potential holding means corresponding to the switching element A is supplied to the buffer circuit among the plurality of potential holding means, so that the display state of the electro-optic element can be set in response to the buffer circuit or the potential holding means.

Next, during the second period, a particular switching element (hereinafter referred to as a switching element B), other than the switching element A, is switched ON among the plurality of first switching elements, and a potential of the potential holding means corresponding to the switching element B is supplied to the buffer circuit among the plurality of potential holding means, so that the display state of the electro-optic element can be set in response to the output of the buffer circuit or the potential holding means. In this manner, the display device can display tone gradations in the time division manner.

In this case, it is more preferable that a third period is provided after the second period. During the third period, the switching element A is switched ON again, and a potential of the potential holding means corresponding to the switching element A is supplied again to the buffer circuit among the plurality of potential holding means, so that the display state of the electro-optic element can be set in response to the buffer circuit.

By displaying tone gradations in the time division manner in the above-explained method, even a moving sight line can catch at least one of the first through third periods, thereby reducing the influence of differences in light emitting timing due to different levels of tone gradations between adjacent pixels (so-called pseudo contour on moving pictures).

Note that, as described before, when the capacitance of the potential holding means is smaller than the electric current outputted from the buffer circuit, the output potential of the buffer circuit must not affect the input potential of the buffer circuit. Thus, it is preferable to use the display device in which the third switching element is provided between the output terminal and the input terminal of the buffer circuit of the display device.

A display method of the present invention by means of the display device is characterized by being arranged so as to include the steps of (f) setting the potential of the plurality of potential holding means to one of a binary potential, and for setting a display state of the electro-optic element to one of no less than two states, while the second switching element is ON, and (g) setting the display states of the plurality of electro-optic elements to states corresponding to the potential which is set in the potential holding means, while the second switching element is OFF.

With the method, a desired number of tone gradations can be displayed, even when each pixel cannot be provided with the number of potential holding means corresponding to a bit number required for displaying the tone gradations. For example, 6-bit tone gradations can be displayed using the display device in which each pixel is provided with less than 6 bits of potential holding means, namely less than 6 potential holding means.

More specifically, for displaying n-bit tone gradations where only m number of potential holding means ($n>m$; n and m are positive integral numbers) can be arranged in the pixel, the electro-optic element can display the remained tone gradations as the multi-valued potential data having no less than two values (preferably no less than three values) while the second switching element is ON.

For example, while the second switching element is ON, one of the m number of potential holding means holds multi-valued potential data having $(n+1-m)$ bits of tone gradations, whereas the remained potential holding means holds data having $(m-1)$ bits (by holding binary potential data in each condenser). Then, while the second switching element is OFF, the potential holding means which holds the multi-valued potential data sets the display state of the electro-optic element so as to display multiple tone gradations. Then, the binary potential data held in the $(m-1)$ number of potential holding means set the display state of the electro-optic element so as to display the tone gradations in the time division manner. In this manner, the electro-optic element can display the remained tone gradations as the multi-valued potential data having not less than three values.

Further, for example, the electro-optic element displays the multi-valued data having $(n-m)$ bits of tone gradations, and m number of potential holding means hold m-bit data (by holding the binary potential data in each condenser), while the second switching element is ON. Then, while the second switching element is OFF, the binary data held in the m number of potential holding means set the display state of the electro-optic element so as to display the tone gradations in the time division manner. In this manner, the electro-optic element can display the remained tone gradations as the multi-valued potential data having not less than two values.

Further, when the amplifier circuit and the inverter circuit are arranged in the pixel as in the present invention, it is preferable that a condenser element is provided between power supplies of the amplifier circuit and of the inverter circuit.

In this case, the condenser element is preferably provided in the pixel. In particular, the condenser element is preferably provided near the power supply terminals of the amplifier circuit and of the inverter circuit.

When the output of the amplifier circuit and of the inverter circuit varies, less noise affects the adjacent pixel if the necessary electric charges are supplied from the condenser provided in the pixel, in comparison to a case where the necessary electric charges are supplied from a peripheral section of the panel. Since the noise causes faulty operation and disturbance in a display quality, the condenser is effectively provided in the pixel for reducing the disturbance.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A display device comprising:

electro-optic elements arranged in a matrix, each of said electra-optic elements being arranged in a vicinity of an intersection of a first line and a second line;

potential holding means for holding a potential so as to drive and display the electro-optic element;

a buffer circuit for outputting a potential supplied from the potential holding means;

a first switching element provided in series with the potential holding means; and a second switching element provided between (1) said first switching element or said potential holding means and (2) the first line, which is switched ON and OFF by the second line, wherein a plurality of said potential holding means are provided with respect to each of the electro-optic elements, and output terminals of said plurality of said potential holding means are connected to an output terminal of said buffer circuit not via a capacitor; and one of said plurality of said potential holding means is selected by said first switching element, and a potential of said potential holding means as selected is applied to an input terminal of said buffer circuit, and said potential holding means as selected is then recharged by an output from said buffer circuit, which corresponds to the potential applied to said input terminal.

2. A display device comprising:

electro-optic elements arranged in a matrix, each of said electro-optic elements being arranged in a vicinity of an intersection of a first line and a second line;

potential holding means for outputting a potential so as to drive and display the electro-optic element;

a buffer circuit for outputting a potential supplied from the potential holding means;

a first switching element provided between (1) each of the electro-optic elements or said buffer circuit and (2) said potential holding means; and a second switching element provided between said first switching element and the first line, which is switched ON and OFF by the second line, wherein a plurality of said potential holding means are provided with respect to each of the electro-optic elements, and output terminals of said plurality of said potential holding means are connected to an output terminal of said buffer circuit not via a capacitor; and one of said plurality of said potential holding means is selected by said first switching element, and a potential of said potential holding means as selected is applied to an input terminal of said buffer circuit, and said potential holding means as selected is then recharged by an output from said buffer circuit, which corresponds to the potential applied to said input terminal.

3. The display device as set forth in claim 1, wherein:

a third switching element is provided between an input terminal and the output terminal of said buffer circuit.

4. The display device as set forth in claim 3, wherein:

said first switching element switches said plurality of said potential holding means while said third switching element is OFF;

said buffer circuit sets a potential of the output terminal of said buffer circuit in accordance with a potential of the input terminal of said buffer circuit while said third switching element is OFF; and said third switching element is switched ON when the potential of the output terminal of said buffer circuit is set.

5. The display device as set forth in claim 3, wherein:

the buffer circuit amplifies an amplitude of an input voltage; and an amplitude of a gate voltage of said third switching element is smaller than an amplitude of an output voltage of the buffer circuit.

6. The display device as set forth in claim 1, wherein:

capacitive coupling means is provided at the intersection of the first line and the second line, so as to couple capacitances between power supply lines of said buffer circuit.

7. The display device as set forth in claim 1, wherein:

the electro-optic element is organic EL (Electro Luminescence).

8. The display device as set forth in claim 1, wherein:

the electro-optic elements are liquid crystal.

9. The display device as set forth in claim 1, wherein:

said potential holding means is a condenser.

10. The display device as set forth in claim 1, wherein:

the buffer circuit includes a first inverter circuit and a second inverter circuit; and an output terminal of the second switching element is connected to an input terminal of the first inverter circuit, whereas an output terminal of the first inverter circuit is connected to an input terminal of the second inverter circuit.

11. The display device as set forth in claim 10, wherein:

each of said first inverter circuit and said second inverter circuit is composed of a p-type TET and an n-type TET.

12. The display device as set forth in claim 1, wherein:

said buffer circuit is a voltage amplifier circuit.

13. The display device as set forth in claim 12, wherein:

the voltage amplifier circuit includes first through third inverter circuits, each being composed of a p-type TFT and an n-type TET.

14. A display method by means of a display device which includes:

electro-optic elements arranged in a matrix, each of said electro-optic elements being arranged in a vicinity of an intersection of a first line and a second line;

potential holding means for holding a potential so as to drive and display the electro-optic element;

a buffer circuit for outputting a potential supplied from the potential holding means;

a first switching element provided in series with the potential holding means; and a second switching element provided between (1) said first switching element or said potential holding means and (2) the first line, which is switched ON and OFF by the second line, wherein a plurality of said potential holding means are provided with respect to each of the electro-optic elements, and output terminals of said plurality of said potential holding means are connected to an output terminal of said buffer circuit not via a capacitor;

said display method comprising the steps of:

(a) setting the potential of the potential holding means corresponding to a potential of the first line, while the second switching element is ON;

(b) applying the potential of the potential holding means to an input terminal of the buffer circuit so as to recharge the potential holding means with the output of the buffer circuit corresponding to the applied potential, while the second switching element is OFF; and (c) controlling a display state of the electro-optic element in response to one of the potential holding means, the buffer circuit and the first line.

15. A display method by means of a display device which includes:

electro-optic elements arranged in a matrix, each of said electro-optic elements being arranged in a vicinity of an intersection of a first line and a second line;

potential holding means for outputting a potential so as to drive and display the electro-optic element;

a buffer circuit for outputting a potential supplied from the potential holding means;

a first switching element provided between (1) each of the electro-optic elements or said buffer circuit and (2) said potential holding means; and a second switching element provided between said first switching element and the first line, which is switched ON and OFF by the second line, wherein a plurality of said potential holding means are provided with respect to each of the electro-optic elements, and output terminals of said plurality of said potential holding means are connected to an output terminal of said buffer circuit;

said display method comprising the steps of:

(a) setting the potential of the potential holding means corresponding to a potential of the first line, while the second switching element is ON;

(b) applying the potential of the potential holding means to an input terminal of the buffer circuit so as to recharge the potential holding means with the output of the buffer circuit corresponding to the applied potential, while the second switching element is OFF; and (c) controlling a display state of the electro-optic element in response to one of the potential holding means, the buffer circuit and the first line.

16. The display method as set forth in claim 14, further comprising the steps of:

(d) selecting one potential holding means among the plurality of potential holding means by means of the first switching element, while the second switching element is OFF; and (e) controlling the display state of the electro-optic element in such a manner that the first switching element switches the potential holding means to supply the potential to the buffer circuit.

17. The display method as set forth in claim 15, further comprising the steps of:

(d) selecting one potential holding means among the plurality of potential holding means by means of the first switching element, while the second switching element is OFF; and (e) controlling the display state of the electrooptic element in such a manner that the first switching element switches the potential holding means to supply the potential to the buffer circuit.

18. A display method by means of a display device which includes:

electro-optic elements arranged in a matrix, each of said electro-optic elements being arranged in a vicinity of an intersection of a first line and a second line;

potential holding means for holding a potential so as to drive and display the electro-optic element;

a buffer circuit for outputting a potential supplied from the potential holding means;

a first switching element provided in series with the potential holding means; and a second switching element provided between (1) said first switching element or said potential holding means and (2) the first line, which is switched ON and OFF by the second line, wherein a plurality of said potential holding means are provided with respect to each of the electro-optic elements, and output terminals of said plurality of said potential holding means are connected to an output terminal of said buffer circuit not via a capacitor; and one of said plurality of said potential holding means is selected by said first switching element, and a potential of said potential holding means as selected is applied to an input terminal of said buffer circuit, and said potential holding means as selected is then recharged by an output from said buffer circuit, which corresponds to the potential applied to said input terminal, said display method comprising the steps of:

(f) setting the potential of the plurality of potential holding means to one of a binary potential, and for setting a display state of the electro optic element to one of no less than two states, while the second switching element is ON; and (g) setting the display states of the plurality of electro-optic elements to states corresponding to the potential which is set in the potential holding means, while the second switching element is OFF.

19. A display method by means of a display device which includes:

electro-optic elements arranged in a matrix, each of said electro-optic elements being arranged in a vicinity of an intersection of a first line and a second line;

potential holding means for outputting a potential so as to drive and display the electro-optic element;

a buffer circuit for outputting a potential supplied from the potential holding means;

a first switching element provided between (1) each of the electro-optic elements or said buffer circuit and (2) said potential holding means; and a second switching element provided between said first switching element and the first line, which is switched ON and OFF by the second line, wherein a plurality of said potential holding means are provided with respect to each of the electro-optic elements, and output terminals of said plurality of said potential holding means are connected to an output terminal of said buffer circuit not via a capacitor; and one of said plurality of said potential holding means is selected by said first switching element, and a potential of said potential holding means as selected is applied to an input terminal of said buffer circuit, and said potential holding means as selected is then recharged by an output from said buffer circuit, which corresponds to the potential applied to said input terminal, said display method comprising the steps of:

(f) setting the potential of the plurality of potential holding means to one of a binary potential, and for setting a display state of the electro-optic element to one of no less than two states, while the second switching element is ON; and (g) setting the display states of the plurality of electro-optic elements to states corresponding to the potential which is set in the potential holding means, while the second switching element is OFF.

* * * * *